US011753193B2

(12) United States Patent
Holmes

(10) Patent No.: US 11,753,193 B2
(45) Date of Patent: Sep. 12, 2023

(54) PHARMACY PACKAGING SYSTEM AND POUCH

(71) Applicant: RXSAFE LLC, Vista, CA (US)

(72) Inventor: William K. Holmes, San Diego, CA (US)

(73) Assignee: RXSAFE LLC, Vista, CA (US)

( * ) Notice: Subject to any disclaimer, the term of this patent is extended or adjusted under 35 U.S.C. 154(b) by 444 days.

(21) Appl. No.: 16/865,774

(22) Filed: May 4, 2020

(65) Prior Publication Data

US 2020/0346793 A1 Nov. 5, 2020

Related U.S. Application Data

(60) Provisional application No. 62/843,025, filed on May 3, 2019.

(51) Int. Cl.

| | |
|---|---|
| ***B65B 57/18*** | (2006.01) |
| ***B65B 5/10*** | (2006.01) |
| ***B65D 75/52*** | (2006.01) |
| ***B65D 75/32*** | (2006.01) |
| ***B65B 57/20*** | (2006.01) |

(52) U.S. Cl.

CPC ..... *B65B 5/103* (2013.01); *B65B 57/18* (2013.01); *B65B 57/20* (2013.01); *B65D 75/32* (2013.01); *B65D 75/527* (2013.01)

(58) Field of Classification Search

USPC ..... 53/473

See application file for complete search history.

(56) References Cited

U.S. PATENT DOCUMENTS

| | | | |
|---|---|---|---|
| 2,208,951 | A | 7/1940 | Tamassy |
| 2,960,808 | A | 11/1960 | Pike |
| 3,439,469 | A | 4/1969 | Van Mil, Jr. |
| 3,552,087 | A | 1/1971 | Schneider et al. |
| 4,067,173 | A | 1/1978 | Borrello |
| 4,493,178 | A | 1/1985 | Buckner et al. |
| 4,546,901 | A | 10/1985 | Buttarazzi |

(Continued)

FOREIGN PATENT DOCUMENTS

| | | | |
|---|---|---|---|
| EP | 0947425 | A1 | 10/1999 |
| EP | 1728718 | A1 | 12/2006 |

(Continued)

OTHER PUBLICATIONS

International Search Report and Written Opinion for Application No. PCT/US2020/031295 dated Jul. 20, 2020 (16 pages).

*Primary Examiner* — Chinyere J Rushing-Tucker
(74) *Attorney, Agent, or Firm* — Michael Best & Friedrich LLP

(57) ABSTRACT

A pouch and an automatic packager for packaging medications into the pouch. One embodiment provides a pouch for containing a plurality of medications. The pouch includes a plurality of discrete compartments, each containing a sub-batch of medications. The pouch also includes serrations at opposite ends of the pouch to separate the pouch from adjacent pouches. The pouch further includes a continuous identifier that spans multiple compartments to give an appearance of one continuous pouch. The plurality of discrete compartments are separated by seals, but not serrations. The continuous identifier includes a border within the opposite ends of the pouch.

17 Claims, 14 Drawing Sheets

(56) References Cited

U.S. PATENT DOCUMENTS

| | | | |
|---|---|---|---|
| 4,655,026 | A | 4/1987 | Wigoda |
| 4,703,765 | A | 11/1987 | Paules et al. |
| 5,029,430 | A | 7/1991 | Davis |
| 5,097,652 | A | 3/1992 | Inamura et al. |
| 5,219,095 | A | 6/1993 | Shimizu et al. |
| 5,348,061 | A | 9/1994 | Riley et al. |
| 5,463,839 | A | 11/1995 | Stange et al. |
| 5,481,855 | A | 1/1996 | Yuyama |
| 5,694,741 | A | 12/1997 | Weder et al. |
| 5,716,114 | A | 2/1998 | Holmes et al. |
| 5,765,606 | A | 6/1998 | Takemasa et al. |
| 5,819,500 | A | 10/1998 | Haraguchi et al. |
| 5,946,883 | A | 9/1999 | Yuyama et al. |
| 6,012,602 | A | 1/2000 | Yuyama et al. |
| 6,036,812 | A | 3/2000 | Williams et al. |
| 6,119,737 | A | 9/2000 | Yuyama et al. |
| 6,170,230 | B1 | 1/2001 | Chudy et al. |
| 6,170,699 | B1 | 1/2001 | Kim |
| 6,256,967 | B1 | 7/2001 | Hebron et al. |
| 6,481,180 | B1 | 11/2002 | Takahasghi et al. |
| 6,478,041 | B1 | 12/2002 | Stede |
| 6,505,457 | B2 | 1/2003 | Grass |
| 6,519,914 | B1 | 2/2003 | Pesho |
| 6,581,355 | B1 | 6/2003 | Yuyama et al. |
| 6,598,368 | B1 | 7/2003 | Haida |
| 6,772,907 | B2 | 8/2004 | Kim |
| 7,028,447 | B2 | 4/2006 | Sung |
| 7,100,792 | B2 | 9/2006 | Hunter et al. |
| 7,118,006 | B2 | 10/2006 | Williams et al. |
| 7,182,105 | B1 | 2/2007 | Feehan et al. |
| 7,428,805 | B2 | 9/2008 | Kim |
| 7,549,268 | B2 | 6/2009 | Kim |
| 7,562,791 | B2 | 7/2009 | Silverbrook et al. |
| 7,637,078 | B2 | 12/2009 | Takahasghi et al. |
| 7,818,947 | B2 | 10/2010 | Kim |
| 7,856,794 | B2 | 12/2010 | Zieher |
| 7,878,366 | B2 | 2/2011 | Cicognani |
| 7,886,508 | B2 | 2/2011 | Yuyama et al. |
| 7,894,656 | B2 | 2/2011 | Kim |
| 8,096,100 | B2 | 1/2012 | Greenwald et al. |
| 8,146,777 | B2 | 4/2012 | Inamura |
| 8,186,542 | B2 | 5/2012 | Kobayashi et al. |
| 8,234,838 | B2 | 8/2012 | Yasunaga et al. |
| 8,678,231 | B2 | 3/2014 | Yuyama et al. |
| 8,794,273 | B2 | 8/2014 | Ansaloni et al. |
| 8,896,322 | B2 | 11/2014 | Rivenbark, Jr. |
| 9,272,796 | B1 | 3/2016 | Chudy |
| 10,187,593 | B2 | 1/2019 | Holmes |
| 10,315,785 | B2 | 6/2019 | Rea et al. |
| 10,427,809 | B2 | 10/2019 | Holmes |
| 10,427,810 | B2 | 10/2019 | Holmes |
| 10,696,437 | B2 | 6/2020 | Persson |
| 10,722,430 | B1 * | 7/2020 | Arora ..... A61J 3/074 |
| 2003/0056467 | A1 | 3/2003 | Kim |
| 2003/0057231 | A1 | 3/2003 | Kim |
| 2006/0259195 | A1 * | 11/2006 | Eliuk ..... B01F 33/8442 700/245 |
| 2007/0151204 | A1 | 7/2007 | Kim |
| 2007/0186514 | A1 | 8/2007 | Vollm et al. |
| 2009/0255948 | A1 | 10/2009 | Bassani |
| 2009/0272758 | A1 | 11/2009 | Karwacki, Jr. et al. |
| 2009/0308964 | A1 | 12/2009 | Chudy et al. |
| 2010/0011715 | A1 | 1/2010 | Freudelsperger |
| 2010/0042255 | A1 | 2/2010 | Boutin |
| 2010/0050570 | A1 | 3/2010 | Mori et al. |
| 2010/0059069 | A1 | 3/2010 | Boldrini |
| 2010/0071320 | A1 | 3/2010 | Ali et al. |
| 2010/0071711 | A1 | 3/2010 | Boldrini |
| 2010/0077707 | A1 | 4/2010 | Kondo et al. |
| 2010/0077708 | A1 | 4/2010 | Kobayashi et al. |
| 2010/0115892 | A1 | 5/2010 | Aylward et al. |
| 2010/0168910 | A1 | 7/2010 | Haas |
| 2010/0287880 | A1 | 11/2010 | Yasunaga et al. |
| 2013/0318915 | A1 | 12/2013 | Iskarous et al. |
| 2013/0318931 | A1 | 12/2013 | Holmes |
| 2014/0245697 | A1 | 9/2014 | Omura et al. |
| 2014/0318078 | A1 | 10/2014 | Kondo et al. |
| 2017/0015445 | A1 | 1/2017 | Holmes |
| 2017/0057682 | A1 | 3/2017 | Chudy |
| 2017/0305589 | A1 | 10/2017 | Yuyama et al. |
| 2018/0318167 | A1 | 11/2018 | Luciano, Jr. et al. |
| 2019/0112080 | A1 | 4/2019 | Holmes |
| 2020/0317382 | A1 | 10/2020 | Savoie-Lavigueur et al. |
| 2020/0331641 | A1 * | 10/2020 | Yuyama ..... B65D 83/0409 |

FOREIGN PATENT DOCUMENTS

| | | | |
|---|---|---|---|
| JP | H11206854 | A | 8/1999 |
| JP | 2006321516 | A | 11/2006 |
| JP | 2007084073 | A | 4/2007 |
| WO | 9929467 | A2 | 6/1999 |
| WO | 2011055037 | A2 | 5/2011 |

* cited by examiner

PHARMACY PACKAGING SYSTEM AND POUCH

CROSS-REFERENCE TO RELATED APPLICATIONS

This application claims priority to U.S. Provisional Patent Application No. 62/843,025, filed May 3, 2019, the entire contents of which are incorporated by reference herein.

FIELD OF THE INVENTION

The present invention relates to pharmacy packaging systems and, more particularly, to a system and method for creating high-capacity pharmacy pouch packages.

SUMMARY

One embodiment provides a pouch for containing a plurality of medications. The pouch includes a plurality of discrete compartments, each containing a sub-batch of medications. The pouch also includes serrations at opposite ends of the pouch to separate the pouch from adjacent pouches. The pouch further includes a continuous identifier that spans multiple compartments to give an appearance of one continuous pouch. In some embodiments, the plurality of discrete compartments may be separated by heat seals, but not serrations. In some embodiments, the continuous identifier may include a border.

Another embodiment provides an automatic packager for packaging pharmaceuticals including a cartridge for dispensing medications, a packaging unit receiving the medications dispensed from the cartridge, and an electronic processor electrically coupled to the cartridge and the packaging unit. The electronic processor is configured to determine medications a batch of medications and determine whether the batch of medications is to be divided based on the medications in the batch of medications. The electronic processor is also configured to divide the batch of medications into a plurality of sub-batches of medications in response to determining that the batch of medications is to be divided and create, using the packaging unit, a pouch including plurality of compartments corresponding to the plurality of sub-batch of medications. The electronic processor is further configured to fill, using the packaging unit, the plurality of compartments with the plurality of sub-batches of medications.

Another embodiment provides a method for packaging pharmaceuticals using an automatic packager including determining, using an electronic processor of the automatic packager, medications in a batch of medications, and determining, using the electronic processor, whether the batch of medications is to be divided based on the medications in the batch of medications. The method also includes dividing, using the electronic processor, the batch of medications into a plurality of sub-batches of medications in response to determining that the batch of medications is to be divided and creating, using the packaging unit, a pouch including a plurality of compartments corresponding to the plurality of sub-batch of medications. The method further includes filling, using the packaging unit, the plurality of compartments with the plurality of sub-batches of medications.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
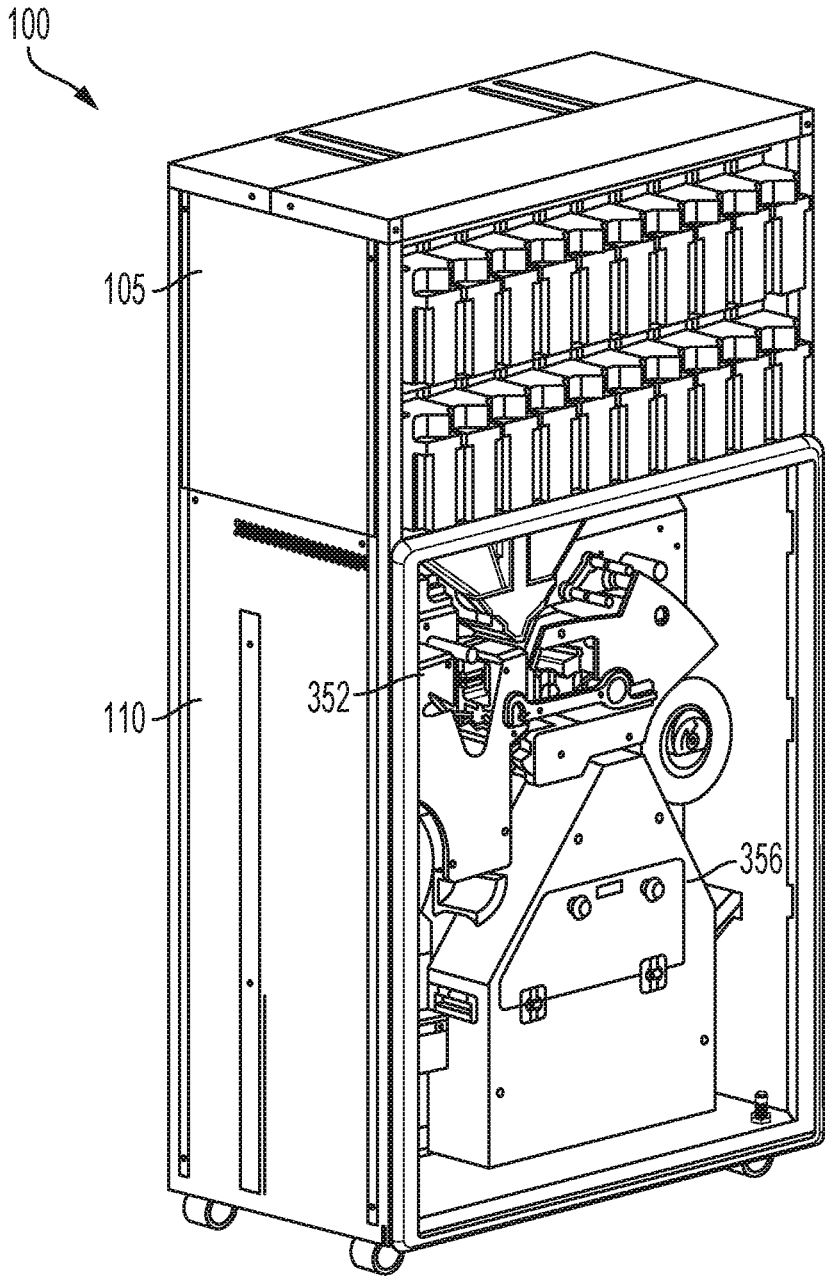
FIG. 1 is a front perspective view of an automatic packager in accordance with some embodiments.

FIG. 1 illustrates an example automatic packager 100 including a universal feed cartridge 105 and a packaging unit 110. The universal feed cartridge 105 receives medications from the bulk canisters and individually dispenses pills to the packaging unit 110. Each universal feed cartridge 105 may dispense up to 20 separate pills at the same time. In the arrangements illustrated in FIG. 1 including the universal feed cartridges 105, the automatic packager 100 may be used to dispense and package twenty different pills at the same time. An example universal feed cartridge is described in U.S. Patent Publication No. 2019/0112080, the entire contents of which are hereby incorporated by reference.

The packaging unit 110 receives the individual pills and packages them into pouch packages to be provided to the consumer. In the example illustrated in FIG. 1, the packaging unit is a strip packager 110. An example strip packager is described in U.S. Patent Publication No. 2013/0318931 and U.S. Patent Publication No. 2017/0015445, the entire contents of both of which are hereby incorporated by reference. FIG. 1 illustrates only example embodiment of an automatic packager 100. The automatic packager 100 may include more or fewer components than those illustrated in FIG. 1 and may perform functions other than those explicitly described herein.

FIGS. 2-6 illustrate one embodiment of a packaging unit 110 for use with the automatic packaging system 100. In the example illustrated, the packaging unit 110 includes a base 114, a manifold 118, a receptacle 122, two feed stock rolls 126, 130, and a take-up roll 134.

Figure 2:
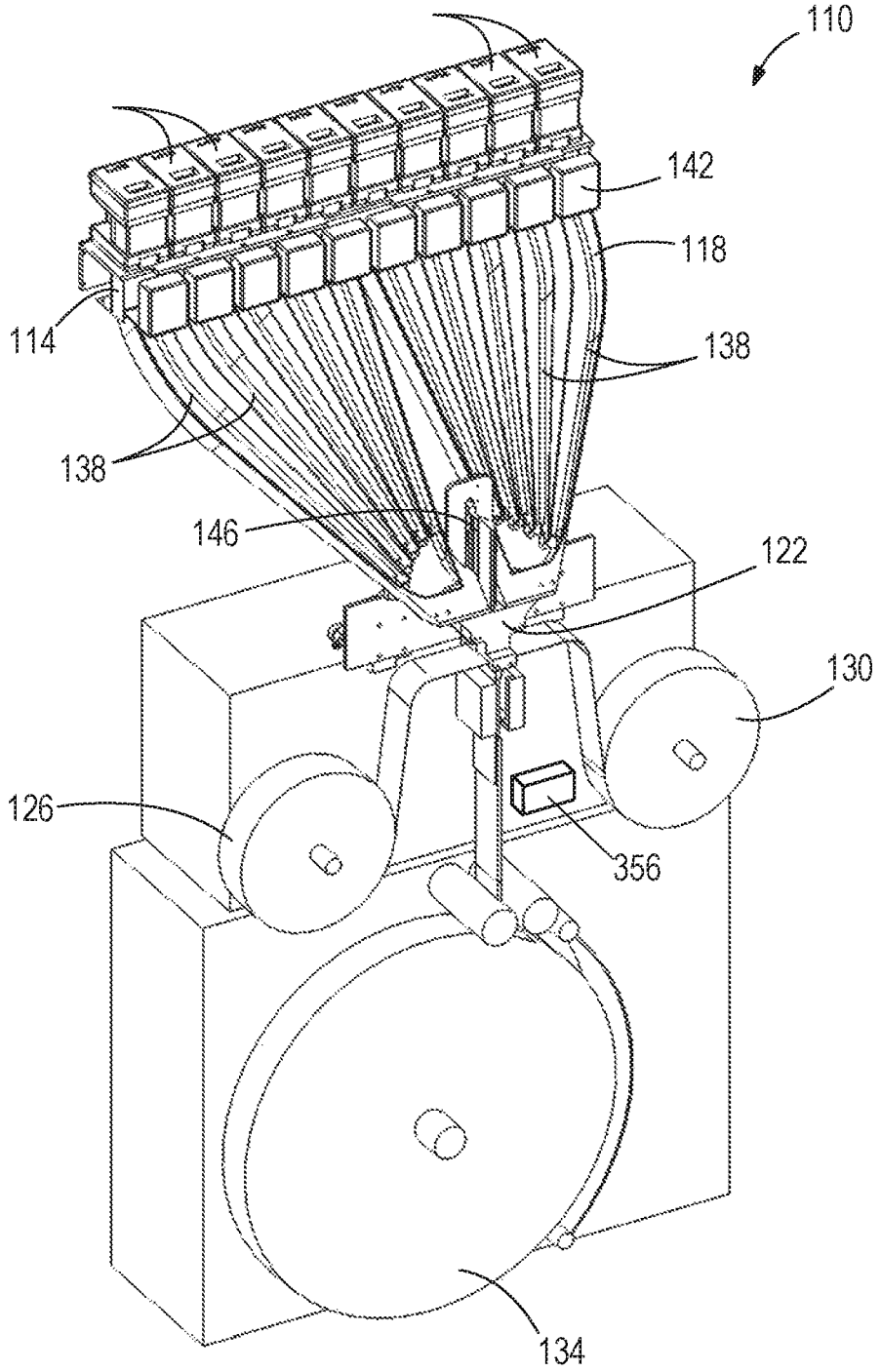
FIG. 2 is a perspective view of a packaging unit of the automatic packager of FIG. 1 in accordance with some embodiments.
Figure 3:
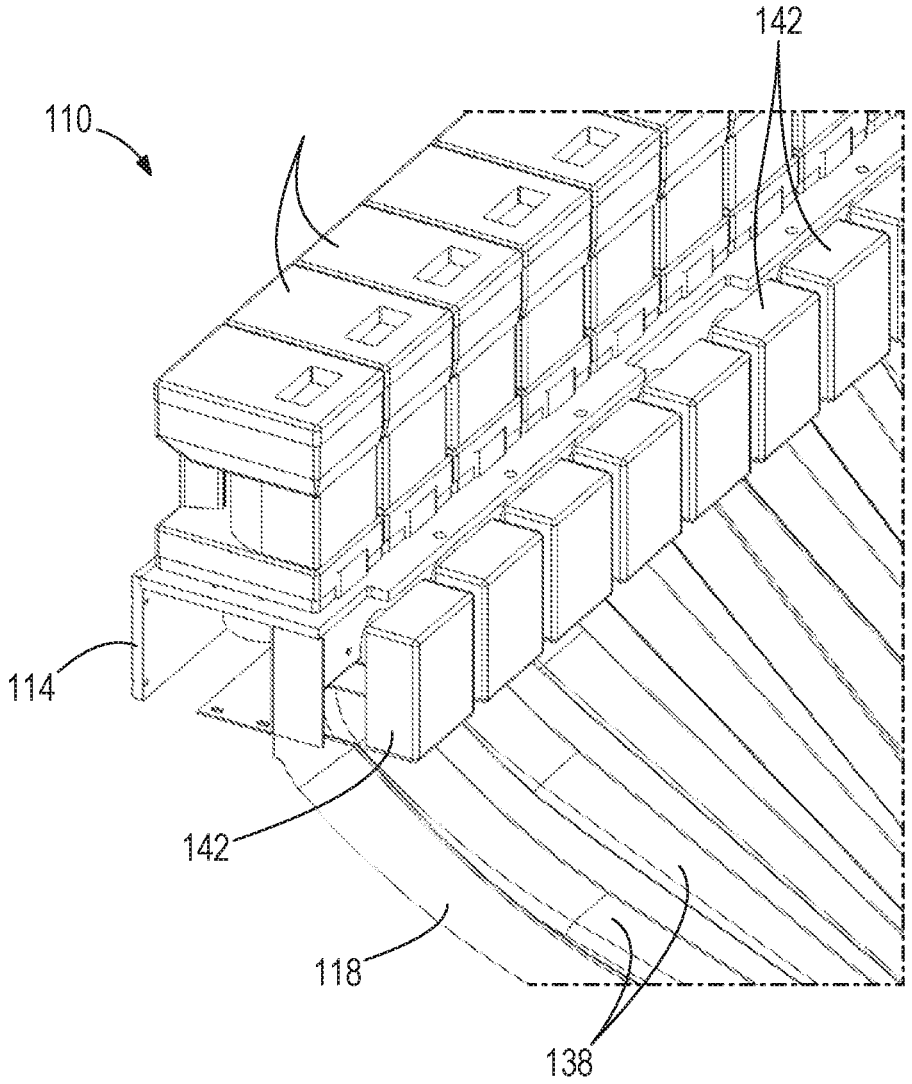
FIG. 3 illustrates a portion of the packaging unit of FIG. 2 including a base and a manifold in accordance with some embodiments.

As shown in FIGS. 2 and 3, the manifold 118 includes a plurality of discrete tracks 138 corresponding to each of a cartridge of the universal feed cartridge 105 mounted on the base 114. The illustrated tracks 138 are independent channels that together form the manifold 118. The tracks 138 isolate the pharmaceuticals from each other as the pharmaceuticals slide down the manifold 118 to the receptacle 122.

As shown in FIG. 3, cameras 142 are mounted to the base 114 adjacent outlets in the base 114. Each camera 142 is associated with one of the cartridges of the universal feed cartridge 105 supported on the base 114. The cameras 142 are operable to determine whether the proper number and/or type of pharmaceuticals are being dispensed from the universal feed cartridge 105. The cameras 142 capture images of pharmaceuticals exiting the base 114 and compare features (e.g., color, contour, size, shape, inscription, etc.) of the pharmaceuticals to stored images of pharmaceuticals. In some embodiments, recognition software may be employed to automatically compare the images captured by the cameras 142 to stored images. In other embodiments, the captured images may be transmitted to a remotely located pharmacist or technician who analyzes the images and verifies that the correct number and type of pharmaceuticals were dispensed. In further embodiments, the cameras 142 may be infrared sensors that only detect whether an object (e.g., a pill) drops through the base 114, rather than identifying the particular type of pharmaceutical.

Figure 4:
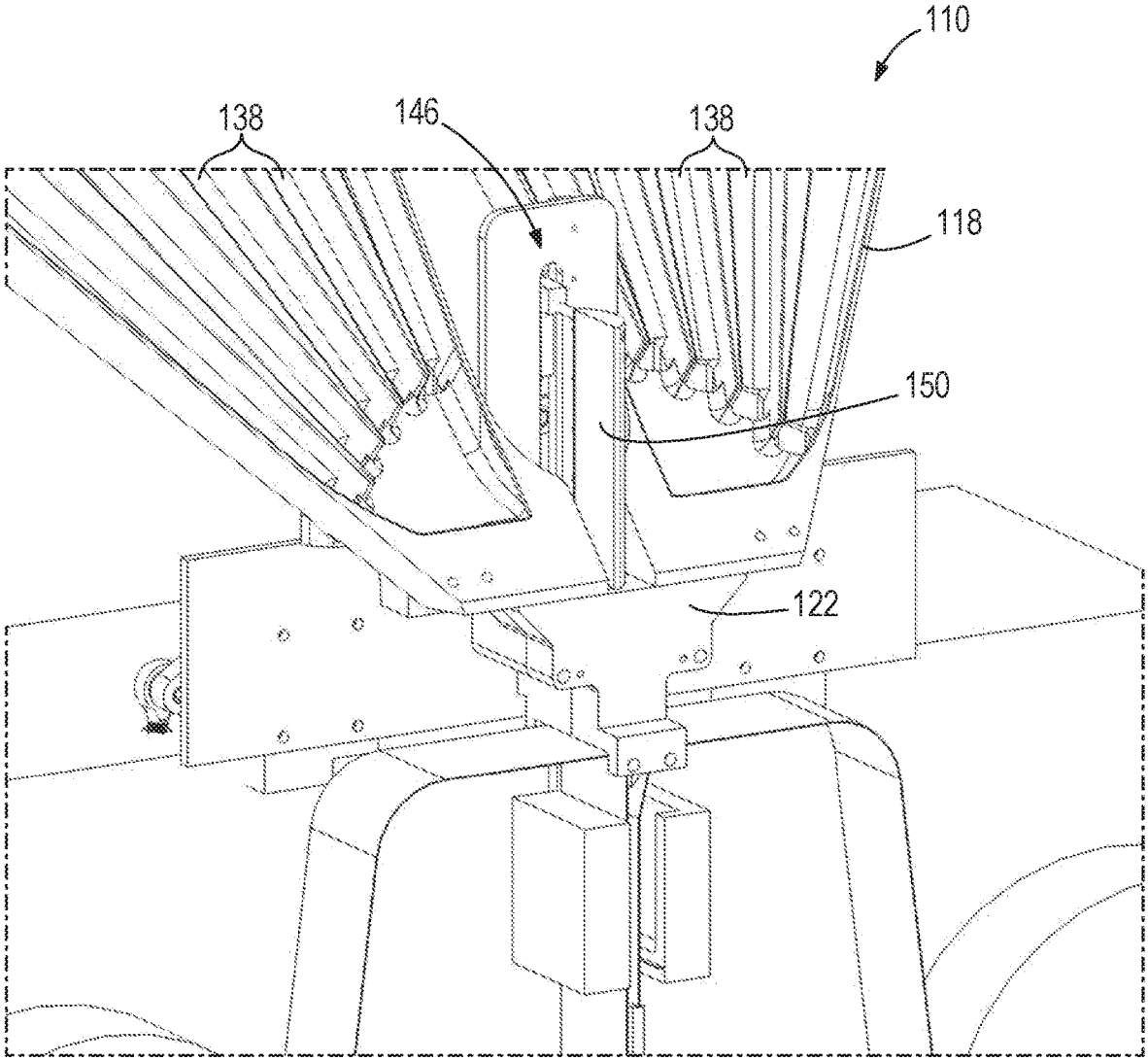
FIGS. 4-6 illustrate another portion of the packaging unit of FIG. 2 including a manifold, a receptacle, and a valve mechanism in accordance with some embodiments.
Figure 5:
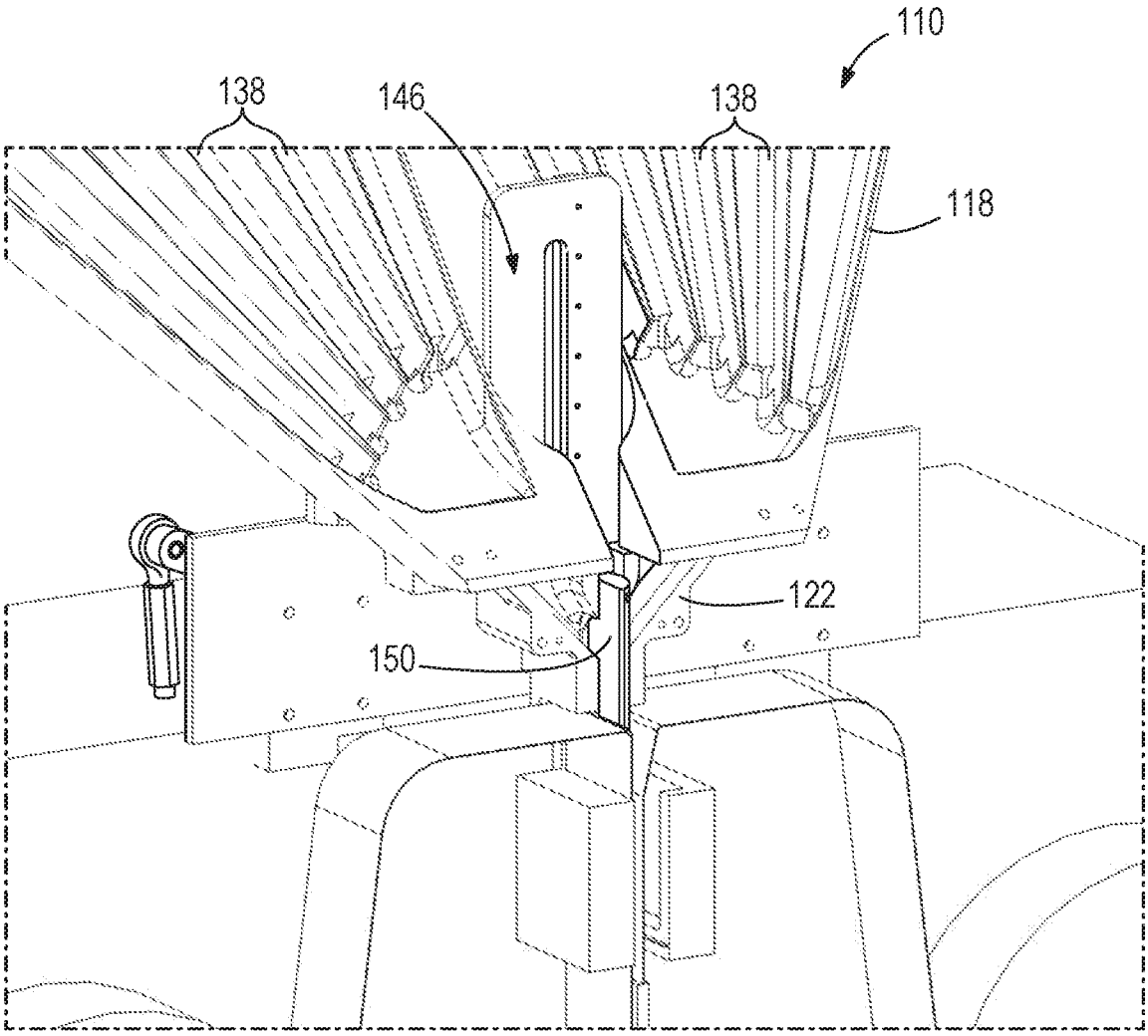
Figure 6:
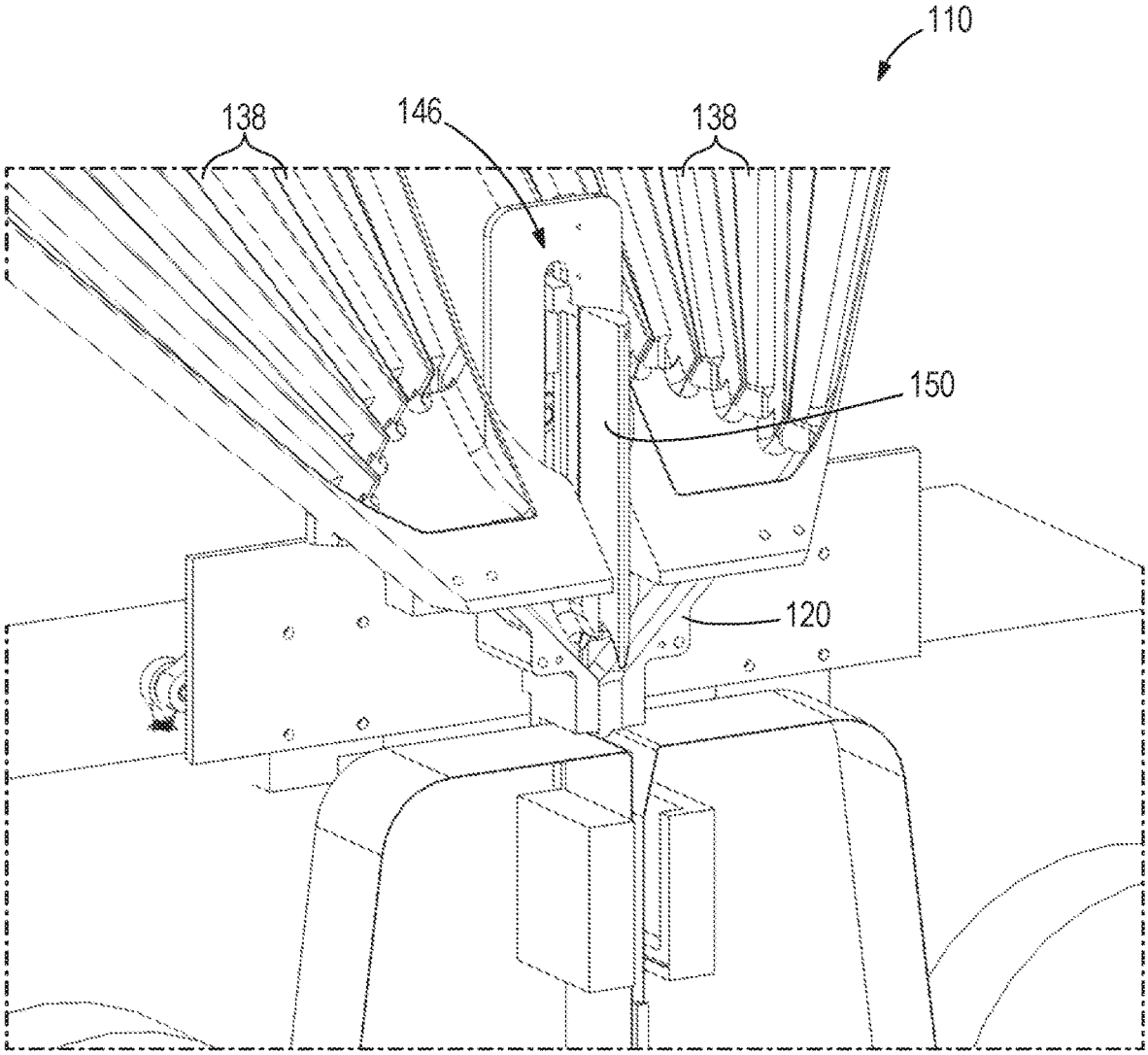

As shown in FIGS. 4-6, the receptacle 122 receives the pharmaceuticals from each of the tracks 138 in the manifold 118. In the illustrated embodiment, the receptacle 122 includes a shutter or valve mechanism 146 that temporarily stops the pharmaceuticals before the pharmaceuticals are collected in a pouch by the feed stock rolls 126, 130. The illustrated shutter mechanism 146 includes a plunger or pushrod 150 that is movable between a first or lowered position (FIG. 5) and a second or raised position (FIG. 6). When in the lowered position, the plunger 150 blocks the pharmaceuticals from traveling out of the manifold 118. When in the raised position, the plunger 150 is moved out of the way to allow the pharmaceuticals to pass toward the packaging equipment (e.g., the feed stock rolls 126, 130). In some embodiments, the shutter mechanism 146 may include a solenoid or other suitable actuator to raise and lower the plunger 150.

In operation, the plunger 150 is initially in the lowered position (FIG. 5) to temporarily stop the pharmaceuticals. The plunger 150 remains in this position until all the requested pharmaceuticals are gathered in the receptacle 122. If an excess or incorrect pharmaceutical is dispensed from the universal feed cartridge 105 (which may be determined by the cameras 142), a gust of air, deflector, or trapdoor may be employed to remove that pharmaceutical from the receptacle 122 or from the manifold 118 before the pharmaceutical reaches the receptacle 122. In some embodiments, detecting whether an excess or incorrect pharmaceutical may include inspecting a pharmaceutical when the pharmaceutical is in flight (e.g., dropping from the base 114 into the manifold 118) as it is released from the universal feed cartridge 105. The cameras 142 mounted on the base 114 may be used to identify each dispensed pharmaceutical, for example, by reading an inscription on the pill. The cameras 142 may be high-speed camera and may include prisms and/or mirrors to capture an all-around image of a dispensed pharmaceutical. The control system may then process the image captured by the high-speed camera 142 to determine whether a correct or intact pharmaceutical was dispensed from the universal feed cartridge 105. Once the proper pharmaceuticals are within the receptacle 122, the plunger 150 is actuated to the raised position (FIG. 6) such that the pharmaceuticals can be packaged in a pouch. The plunger 150 is then re-actuated to the lowered position to help push the pharmaceuticals into the pouch and await the next batch of pharmaceuticals.

Figure 7:
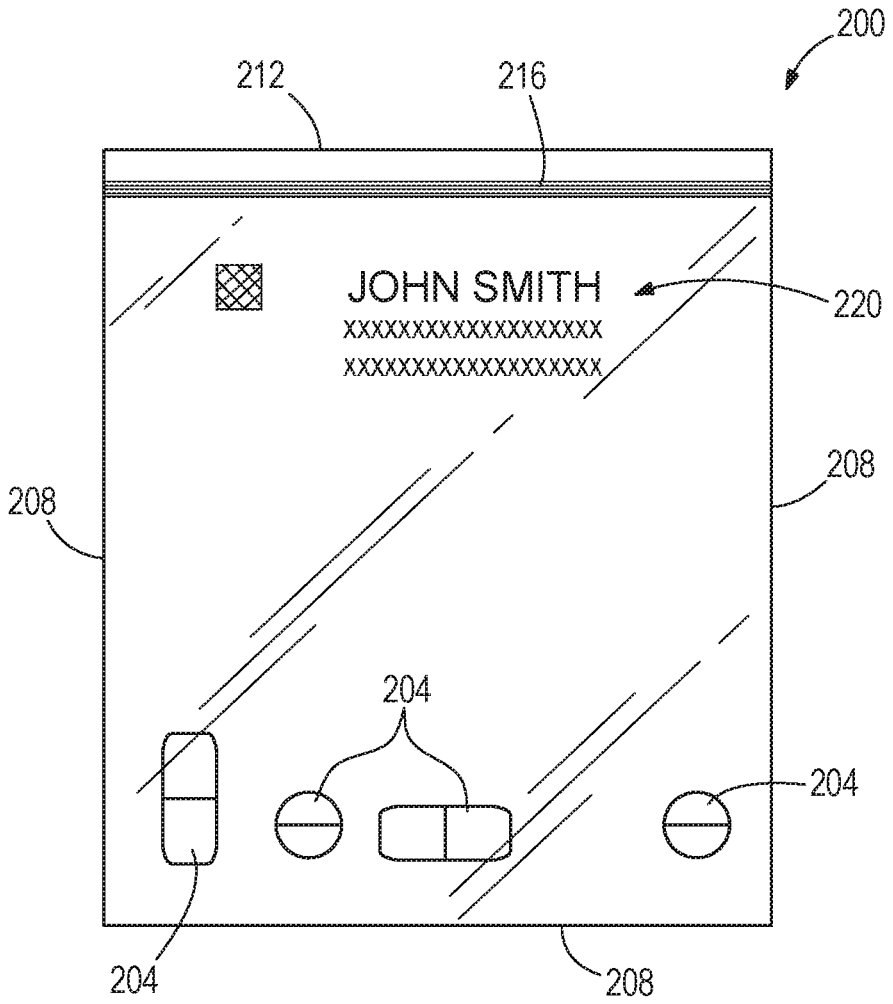
FIG. 7 illustrates a pouch with pharmaceuticals packaged inside in accordance with some embodiments.

FIG. 7 illustrates a pouch 200 containing different pharmaceuticals 204 therein. The illustrated pouch 200 is an example of a pouch that may be formed using the packaging equipment of the packaging unit 110 described above. The pouch 200 is a clear plastic (e.g., cellophane) bag having three closed edges 208 and an open edge 212. A heat seal 216 extends across the pouch 200 adjacent the open edge 212 to seal the pouch 200. In some embodiments, all four edges 208, 212 of the pouch 200 may be closed via heat seals. Additionally or alternatively, the pouch 200 may be composed of an opaque and/or non-plastic material. For example, one or both sides of the material may be opaque or colored (e.g., amber colored). As discussed above, identification indicia 220 (e.g., a patient's name, a barcode, types of pharmaceuticals, etc.) are printed on the pouch 200 using, for example, a thermal printer, an inkjet printer, a thermal transfer ribbon, or the like. In other embodiments, the identification indicia 220 may be printed on a label that is coupled to the pouch 200 with adhesives. In further embodiments, the pouch 200 may include a header area and/or a footer area without medication, but that provides space to print or apply the indicia 220. In some embodiments, the packaging unit 110 may dispense empty (i.e., non-filled) pouches including certain information for a patient. The information may include, for example, instructions on how or when to take the pharmaceuticals, reminders to get new batch of pharmaceuticals, or the like.

Figure 9:
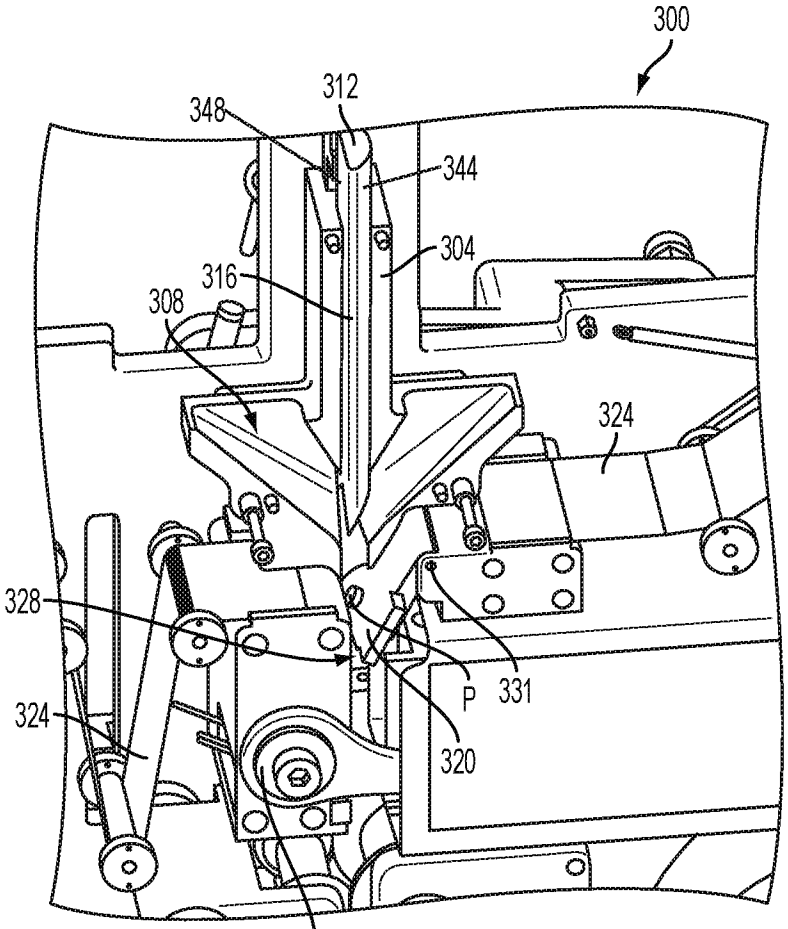
FIG. 9 illustrates a portion of the packaging unit of FIG. 8 with the valve mechanism in a second position in accordance with some embodiments.
Figure 8:
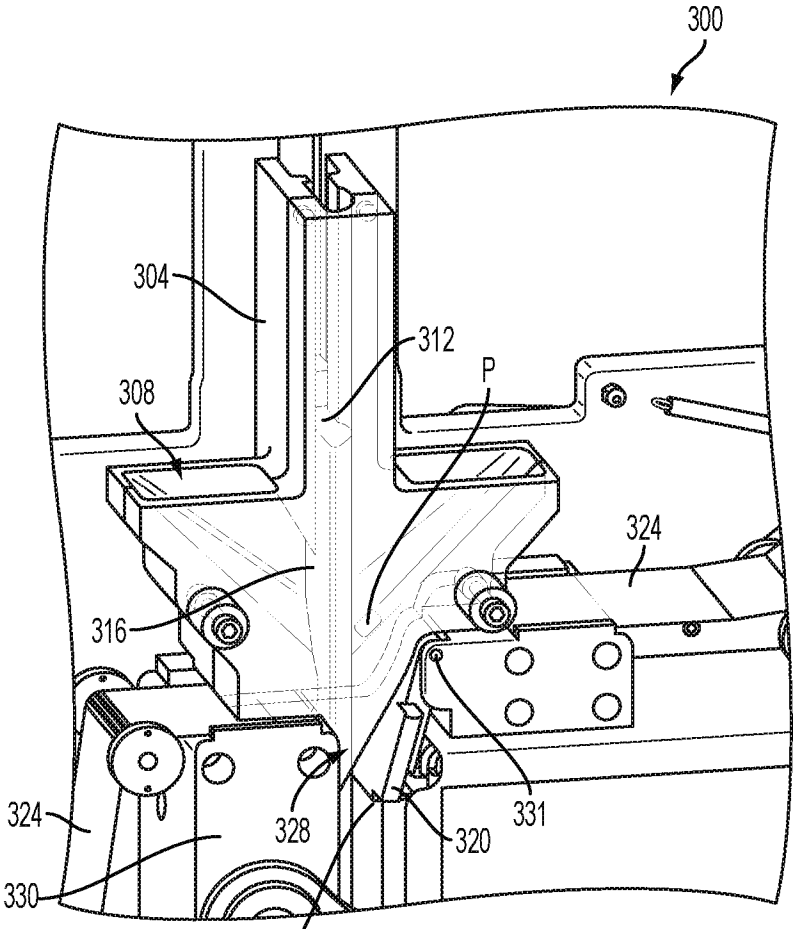
FIG. 8 illustrates a portion of a packaging unit of the automatic packager of FIG. 1, the packaging unit including a valve mechanism in a first position in accordance with some embodiments.

FIGS. 8 and 9 illustrate a portion of another packaging unit 300 for use with the automatic packaging system 100. The packaging unit 300 is similar to the packaging unit 110 discussed above. Reference is hereby made to the description of the packaging unit 110 above for description of features and elements of the packaging unit 300 not specifically discussed below.

In the illustrated embodiment, the packaging unit 300 includes a receptacle 304 to control pharmaceuticals (e.g., pills P) as the pharmaceuticals are packaged into a pouch (e.g., the pouch 200 shown in FIG. 7). The receptacle 304 receives pharmaceuticals from one or more tracks (e.g., the tracks 138 of the manifold 188 shown in FIG. 2) and directs the pharmaceuticals toward packaging equipment. As explained above, the packaging equipment can include two feed stock rolls and a take-up roll (e.g., the rolls 126, 130, 134 shown in FIG. 2) to form a pouch. In other embodiments, the packaging equipment can include a single feed stock roll. The receptacle 304 is located upstream of the packaging equipment to receive the pharmaceuticals from the track before the pharmaceuticals reach the packaging equipment.

The illustrated receptacle 304 includes a collection area 308 and a valve mechanism 312. The collection area 308 communicates with the track to receive pharmaceuticals. The valve mechanism 312 blocks the pharmaceuticals before the pharmaceuticals reach the packaging equipment. In the illustrated embodiment, the valve mechanism 312 includes a plunger or injector 316. The plunger 316 is movable relative to the track and the collection area 308 between a first or lowered position (FIG. 8) and a second or raised position (FIG. 9). When in the lowered position, the plunger 316 blocks the pharmaceuticals from moving out of the collection area 308 toward the packaging equipment. When in the raised position, the plunger 316 is moved out of the way to allow the pharmaceuticals to pass toward the packaging equipment. In the illustrated embodiment, the plunger 316 slides linearly between the lowered and raised positions. In some embodiments, the valve mechanism 312 may include a solenoid or other suitable actuator to raise and lower the plunger 316.

The illustrated receptacle 304 also includes a flapper 320. The flapper 320 is located downstream of the collection area 308. The flapper 320 helps manage material 324 being released by the feed stock rolls of the packaging equipment to form pouches. In particular, the flapper 320 extends into a path 328 between the collection area 308 and the packaging equipment and engages the material 324 to inhibit the material 324 from being torn or from binding. In addition, the flapper 320 helps hold edges of the material 324 close to each other for sealing. In the illustrated embodiment, the flapper 320 is pivotable relative to the path 328 about a pivot shaft 331. In other embodiments, the flapper 320 may move linearly relative to the path 328. In some embodiments, the flapper 320 may be biased by, for example, a spring, into the path 328.

In some embodiments, the flapper 320 may also selectively block the path 328 between the collection area 308 and the packaging equipment. When the plunger 316 is in the raised position (FIG. 9), the illustrated flapper 320 extends into the path 328 between the receptacle 304 and the packaging equipment. In this position, the pharmaceuticals are held above a pouch before the pharmaceuticals are loaded into the pouch. When the plunger 316 is in the lowered position (FIG. 8), the flapper 320 is moved out of the path 328, allowing the plunger 316 to extend through the path 328. If a pharmaceutical was being held on the flapper 320 before the plunger 316 moved to the lowered position, the pharmaceutical is also forced by the plunger 316 into the pouch formed by the packaging equipment. When the plunger 316 is moved back to the raised position, the leading edge of the flapper 320 pushes the two halves of the pouch (i.e., the two strips of material 324) flat against each other.

In other embodiments, the flapper 320 may include a carve-out or recess along its leading edge. The carve-out may generally match the shape and contour of the plunger 316. The carve-out provides a hole for pharmaceuticals to move into a pouch without being blocked by the flapper 320. In such embodiments, the flapper 320 does not pinch the two sides of the pouch tight against each other along an entire edge, but only pushes the two side edges of the pouch close together so the upper edge of the pouch can be closed.

In some embodiments, the plunger 316 is held between the material 324 as the pouch is being formed. More particularly, the pouch is formed by sealing (e.g., heat sealing) the two strips of material 324 along three edges (e.g., the bottom edge and the two side edges). This sealing process can be performed in a single step using a U-shaped sealing mechanism 330. Before the two strips of material 324 are sealed together, the plunger 316 is positioned between the strips of material 324. The sealing mechanism 330 then creates the seal around the plunger 316. By creating the seal around the plunger 316, the two strips of material 324 are connected together, but do not lie flat against each other. When the plunger 316 is moved to the raised position (FIG. 9), the plunger 316 moves out from between the two strips of material 324, and the pouch is left open at the top. As further explained below, the plunger 316 can be moved back to the lowered position (FIG. 8) to help push the pharmaceuticals into the pouch. The two strips of material 324 can then be advanced so that the plunger 316 is between upstream sections of the material 324. When the next pouch is ready to be formed, the U-shaped sealing mechanism 330 can again seal the two strips of material 324 along three edges. The bottom seal of this pouch becomes the top seal of the previous pouch. A cutting mechanism can then create, at generally the same time and stroke, a line of serrations through the bottom/top seal between pouches to facilitate later separating the pouches. Alternatively, the cutting mechanism can cut apart the pouches at the seal as the pouches are completed.

Figure 10:
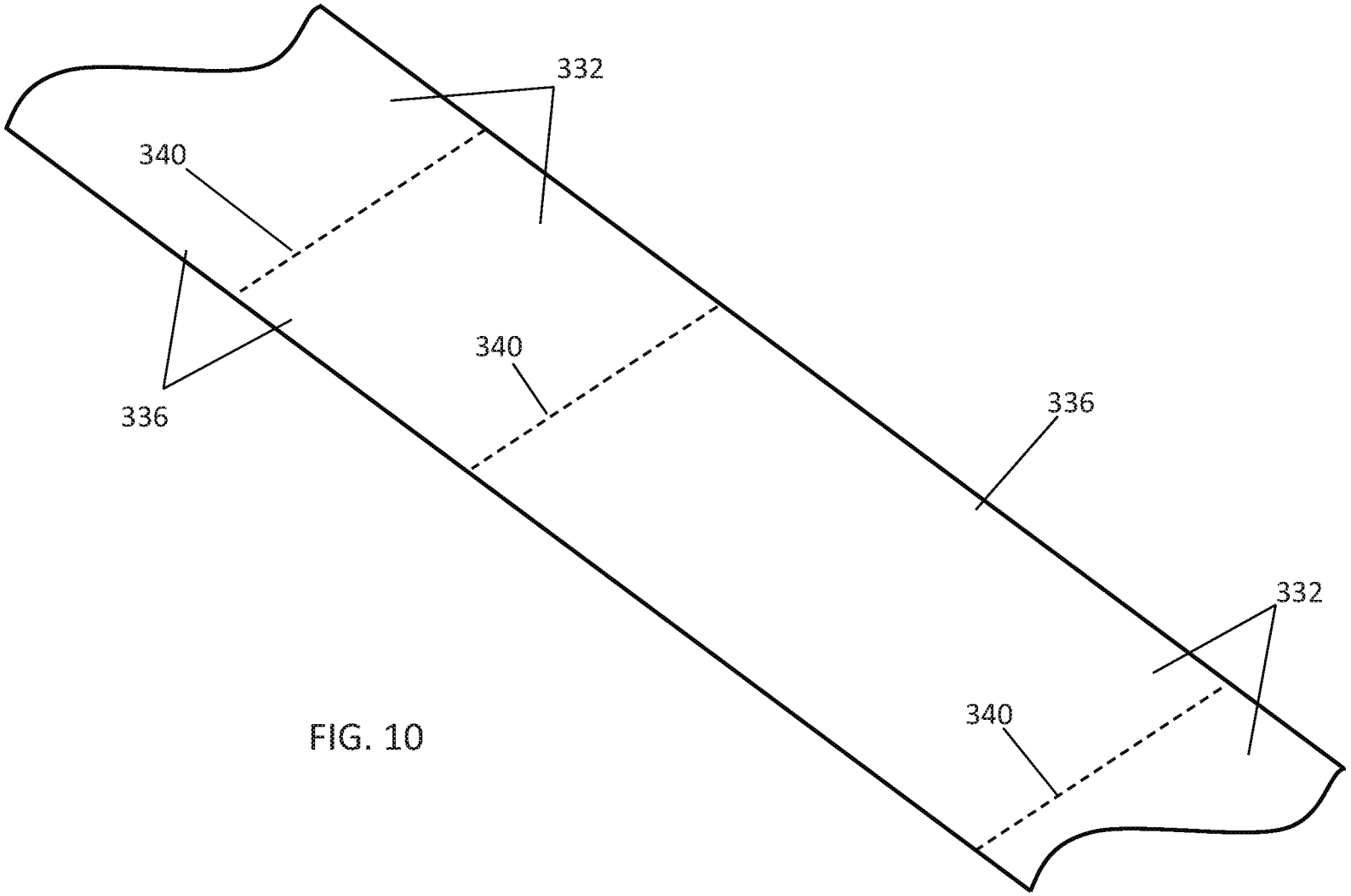
FIG. 10 illustrates a series of pouches formed using the packaging unit of FIG. 2 in accordance with some embodiments.

FIG. 10 illustrates part of a series or strip of pouches 332 created using the packaging unit 300. The pouches 332 are sealed along all four edges with heat seals 336. Serrations 340 are formed in the heat seals 336 between the pouches 332 to facilitate separating the pouches 332. As shown in FIG. 10, the pouches can be different lengths to accommodate, for example, different amounts of pharmaceuticals.

Referring back to FIGS. 8 and 9, in operation, the valve mechanism 312 physically pushes pharmaceuticals into a pouch to load the pouch, rather than relying on gravity for the pharmaceuticals to fall into the pouch. In particular, the plunger 316 of the valve mechanism 312 is initially in the lowered position (FIG. 8) as the receptacle 304 receives pharmaceuticals from the track. While in the lowered position, the plunger 316 blocks pharmaceuticals from traveling to the packaging equipment so that all of the pharmaceuticals are first collected in the collection area 308. Blocking the pharmaceuticals with the valve mechanism 312 allows the pharmaceuticals to settle together toward the bottom of the collection area 308 while the previous pouch is still being sealed. The valve mechanism 312 inhibits the pharmaceuticals from going into the wrong pouch. The valve mechanism 312, thereby, increases the accuracy and speed of the packaging unit 300 and provides error prevention. The valve mechanism 312 also inhibits the pharmaceuticals from being crushed or damaged in the sealing area of the pouches by the sealing mechanism 330. Additionally, the pouch is advanced at generally the same speed as the valve mechanism 312 to inhibit the valve mechanism from damaging the pharmaceuticals or the pouch.

During this time, each feed stock roll of the packaging equipment releases material 324 to form a pouch. The material 324 from each feed stock roll forms half of the pouch. The two halves are secured together along three sides or edges (e.g., the bottom and the two sides) to close the sides and form the pouch. In the illustrated embodiment, the sides of the pouch are closed by, for example, heat sealing. Because the pouches are made on-demand from feed stock rolls, the pouches can be made variable in length (e.g., longer or shorter), as shown in FIG. 10, depending on the amount of pharmaceuticals being packaged. For example, pouches are made having lengths between about 1 inch and about 3¼ inches, although other lengths of pouches are also possible. The length of the pouch may be determined automatically by the packaging equipment based on the amount of pharmaceuticals expected to be loaded into the pouch, and the area needed to print indicia and other information on the pouch. The amount of material needed to form a particular pouch can be identified on the material 324 by an indexing mark (e.g., a black line) drawn on the material 324. Once the packaging equipment sees this mark, the feed stock rolls stop releasing material 324. In embodiments where the packaging equipment only includes a single feed stock roll, the material 324 from the single roll may be folded along one side or edge to close the edge. In either embodiment, the material 324 may be pre-printed with indicia regarding the pharmaceuticals and patient. After the pouch is initially formed, one of the heat-sealing elements is moved away from the material 324. This action causes the pouch to open along its upper, unclosed edge.

The illustrated plunger 316 also helps form and shape the pouch. When the plunger 316 is in the lowered position, the plunger 316 is located between the two strips of material 324 that form the pouches. The material 324 can be closed (e.g., heat sealed) along three edges (e.g., the bottom and two sides) to form the initial shape of the pouch. In the illustrated embodiment, the plunger 316 includes a substantially curved outer surface 344 on one side and a substantially flat outer surface 348 on the opposite side. The curved outer surface 344 shapes one of the strips of material 324 in an arch relative to the other strip of material 324. This arrangement causes the arched strip of material 324 to not lie flat against the other strip of material 324, making it easier for pharmaceuticals to fill the pouch. In addition, when the plunger 316 is removed from the pouch, a hole or gap is left between upper edges of the material 324, allowing the pharmaceuticals to more easily move into the pouch.

In some embodiments, once the pouch is formed around the plunger 316, the plunger 316 moves to the raised position (FIG. 9). The pharmaceuticals are then released from the respective cartridges of the universal feed cartridge 105. The pharmaceuticals fall through the manifold 118 and into the pouch due to gravity. The plunger 316 moves to a second position at the top of the pouch where the opening is formed to help push the pharmaceuticals into the pouch. The plunger 316 then moves to the lowered position (FIG. 8) and the material 324 is advanced by the packaging equipment at generally the same speed that the plunger 316 moves. When the plunger 316 is in the lowered position (FIG. 8), the top of the pouch is sealed along with the sides of a new pouch as described below.

In other embodiments, once all of the required pharmaceuticals are collected in the collection area 308 and the pouch is formed, the plunger 316 moves to the raised position (FIG. 9). The pharmaceuticals then fall out of the collection area 308 toward the flapper 320, which in some embodiments blocks the path 328 to the packaging equipment. The plunger 316 then moves back to the lowered position (FIG. 8) to help push the pharmaceuticals into the pouch. The material 324 is advanced by the packaging equipment at generally the same speed that the plunger 316 moves so the plunger 316 does not crush or damage the pharmaceuticals, particularly if the pouch is being filled with many pharmaceuticals (e.g., 15-20 pills, or more). Instead, the plunger 316 pushes the pharmaceuticals to move the pharmaceuticals past and out of the way of the sealing mechanism 330 so the sealing mechanism 330 can make the top seal in the pouch. In some embodiments, the plunger 316 may also actuate a cam-type mechanism that moves the flapper 320 slightly ahead of movement of the plunger 316. By helping push the pharmaceuticals into the pouch with the plunger 316, more pharmaceuticals can be loaded into the pouch more reliably. For example, in some embodiments, the plunger 316 may be used to move 10-40 pharmaceuticals into a single pouch. Such volume of pharmaceutical loading into a pouch may not be attainable by relying on gravity alone. In addition, such an arrangement allows more pharmaceuticals to be loaded into a single pouch than conventional devices, which reduces the possibility of confusing a patient by providing all of the pharmaceuticals in a single pouch (rather than multiple pouches each containing a small number of pills).

As the pharmaceuticals are loaded into the pouch by the plunger 316, the material 324 is advanced to begin forming the next pouch around the plunger 316. The flapper 320 is pivoted toward the plunger 316 to help hold edges of the material 324 together. Once the material 324 is sufficiently advanced by the feed stock rolls, a fourth side or edge (e.g., the top) of the pouch is closed by the sealing mechanism 330. Similar to the other sides, the fourth side of the pouch may be closed by, for example, heat sealing. As noted above, the seal forming the fourth (or top) side of the pouch may also form the bottom seal of the next pouch. This process is continued to create a series of discrete pouches, as shown in FIG. 10.

The sealing mechanism 330 creates the top seal along a sealing area (for example, areas along the serrations 340, 612, 712 or the heat seals 714 without serrations) of the pouch. If a medication is present in the sealing area 334 of the pouch, the sealing mechanism 330 may crush or break the medication rendering the medication useless for distribution. To prevent this breakage, a sensor 338 (for example, a camera) may be provided by the sealing mechanism 330 (see FIG. 12) to detect medications that may be obstructing the sealing area 334. The packaging unit 300 may stop sealing the pouch when a medication is detected by the sensor 338. In some embodiments, a vibration mechanism may also be provided with the sealing mechanism 330 to vibrate the pouch such that the medications settle into the pouch out of the sealing area 334. In some embodiments, a sensor (e.g., a camera) may also be provide along the tracks 138 to detect whether a medication is stuck in the tracks 138 and has not made it to the pouch. The pouch may be prevented from being sealed when the sensor in the tracks 138 detects a medication stuck in the tracks. Particularly, the sensor in the tracks 138 detects whether a pathway to the pouches is clear before the pouch is sealed.

The receptacle 304 of the packaging unit 300 facilitates loading pharmaceuticals into pouches more accurately, faster, and at a higher capacity than packaging units which rely on gravity feed. As such, the pouches can be filled more reliably.

Figure 12:
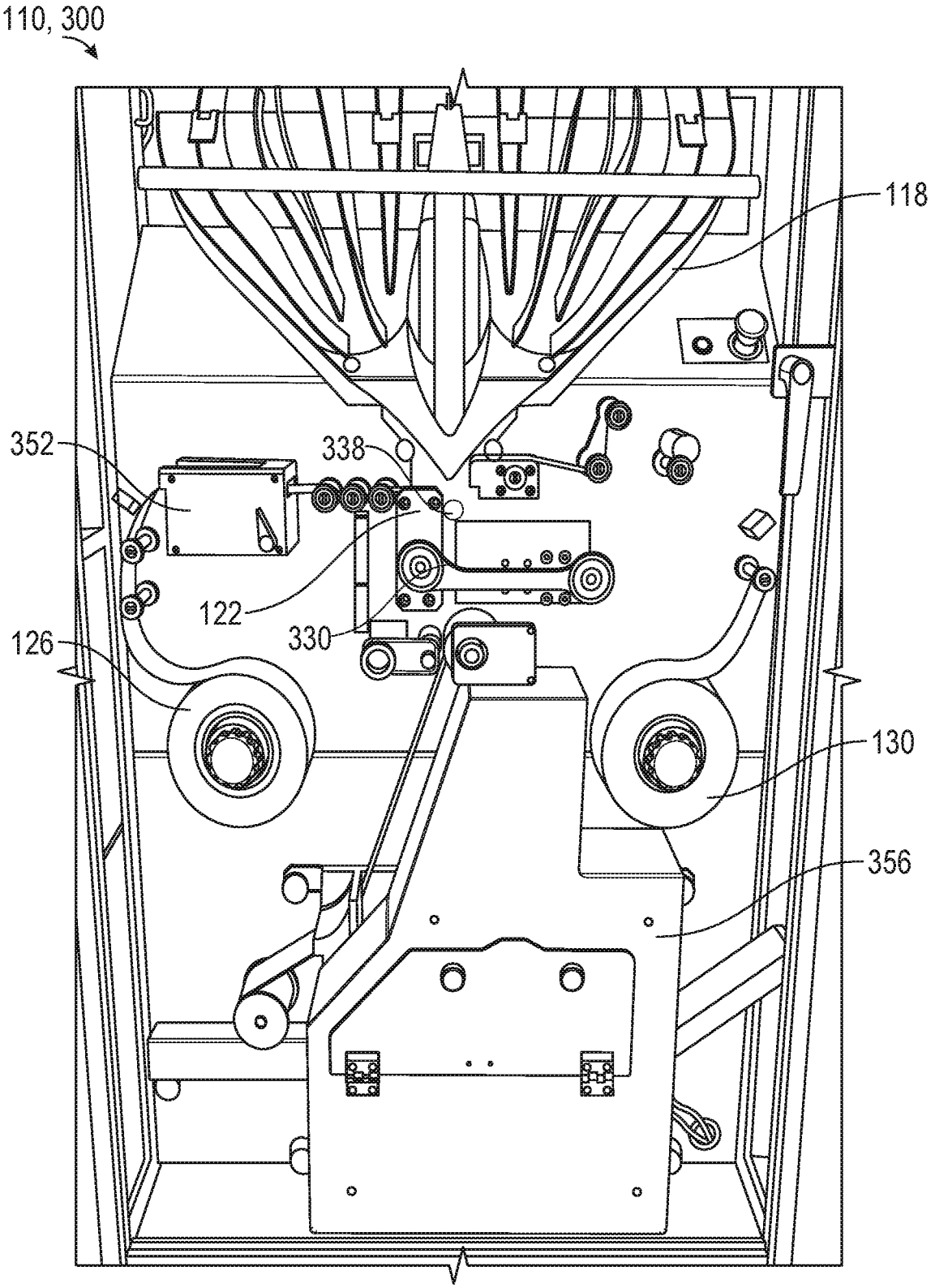
FIG. 12 is a front view of the packaging unit of FIG. 2 in accordance with some embodiments.

Referring to FIGS. 1 and 12, in some embodiments, the packaging unit 110, 300 may include a printer 352 to print a patient's name, the date, the amount and type of pharmaceuticals contained within, a bar code, and/or other indicia on the pouches as the pouches are formed. The printer 352 may be, for example, a thermal printer. In other embodiments, the printer 352 may include an ink ribbon or an ink jet. In addition, the packaging unit 110, 300 may include a bar code scanner or vision system 356 to monitor and check the pouches as they are spooled onto the take-up roll 134 or dispensed.

Figure 11:
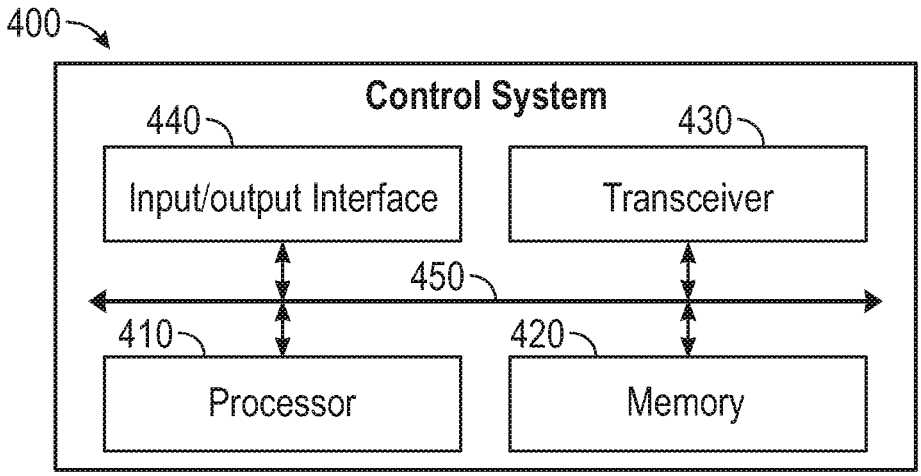
FIG. 11 is a simplified block diagram of a control system of the automatic packager of FIG. 1 in accordance with some embodiments.

FIG. 11 illustrates one embodiment of a control system 400 for the automatic packager 100. The control system 400 controls operation of the feed stock rolls 126, 130 to release and form a pharmaceutical pouch, the printer 352 to print indicia on the material 324, and other components of the automatic packager 100. In the example illustrated, the control system 400 includes a processor 410, a memory 420, a transceiver 430, and an input/output interface 440. The processor 410, the memory 420, the transceiver 430, and the input/output interface 440 communicate over one or more control and/or data buses (e.g., a communication bus 450). FIG. 11 illustrates only one exemplary embodiment of a control system 400. The control system 400 may include more or fewer components and may perform functions other than those explicitly described herein.

In some embodiments, the processor 410 is implemented as a microprocessor with separate memory, such as the memory 420. In other embodiments, the processor 410 may be implemented as a microcontroller (with memory 420 on the same chip). In other embodiments, the processor 410 may be implemented using multiple processors. In addition, the processor 410 may be implemented partially or entirely as, for example, a field-programmable gate array (FPGA), an application specific integrated circuit (ASIC), and the like, and the memory 420 may not be needed or be modified accordingly. In the example illustrated, the memory 420 includes non-transitory, computer-readable memory that stores instructions that are received and executed by the processor 410 to carry out functionality of the control system 400 described herein. The memory 420 may include, for example, a program storage area and a data storage area. The program storage area and the data storage area may include combinations of different types of memory, such as read-only memory and random-access memory.

The transceiver 430 enables wireless communication from the control system 400 to, for example, a remote electronic device such as a server or a smart telephone or a tablet computer of a remote pharmacist. In other embodiments, rather than the transceiver 430, the control system 400 may include separate transmitting and receiving components, for example, a transmitter and a receiver. In yet other embodiments, the control system 400 may not include a transceiver 430 and may communicate with a remote device via a network interface and a wired connection to a communication network such as the Internet.

As noted above, the control system 400 may include the input/output interface 440 (or more commonly referred to as a user interface). The input/output interface 440 may include one or more input mechanisms (e.g., a touch screen, a keypad, a button, a knob, and the like), one or more output mechanisms (e.g., a display, a printer, a speaker, and the like), or a combination thereof. The input/output interface 440 receives input from the input devices actuated by a user and provides output to the output devices with which a user interacts. In some embodiments, as an alternative or in addition to managing inputs and outputs through the input/output interface 440, the control system 400 may receive user inputs, provide user outputs, or both by communicating with an external device, such as a console computer, over a wired or wireless connection.

A user can interact with the packaging unit 110, 300 through the control system 400 to input patient information, facility information, and/or the pharmaceuticals needed. The control system 400 can control operation of the universal feed cartridge 105 to individually dispense medications to the packaging unit 110, 300. The control system 400 can also control operation of the packaging unit 110, 300 to form the pouches around the dispensed medications.

FIG. 12 illustrates another view of the packaging unit 110, 300. In the example illustrated, the packaging unit 110, 300 also includes a verification system 356. The verification system 356 is positioned downstream of the receptacle 122 and the pouch sealing mechanism 330, between the feed stock rolls 126, 130 and the take-up roll 134 (or dispenser). An example verification system is described in U.S. Pat. No. 10,187,593, the entire contents of which are hereby incorporated by reference.

In operation, the automatic packager 100 is used to package medications in batches with each batch being provided in a separate pouch package. The pouch packages are verified using the verification system 356. Any number of medications may be packaged in a single pouch package using the automatic packager 100 by varying the size of the single pouch as described above. However, a large number of pills in a single pouch may complicate the implementation of verification using the verification system. For example, if a single pouch includes more than seven medications, the medications may overlap each other during the verification process, making it difficult to identify which medications and how many medications are in the pouch. Some medications should be packaged in different pouches to avoid affecting each other (e.g., if one medication gives off water, while another medication absorbs water). Some medications known to be allergenic (e.g., penicillin) may need to be packaged separately from other medications. In addition, some expensive medications (e.g., HIV medication) may not be repackaged or re-used if they come in contact with other medications or substances. In these instances, these expensive medications are packaged separately should there arise a need for reusing or repackaging the medication. An example method 500 provided below allows for dividing a single batch of medications into multiple sub-batches for ease of verification.

Figure 13:
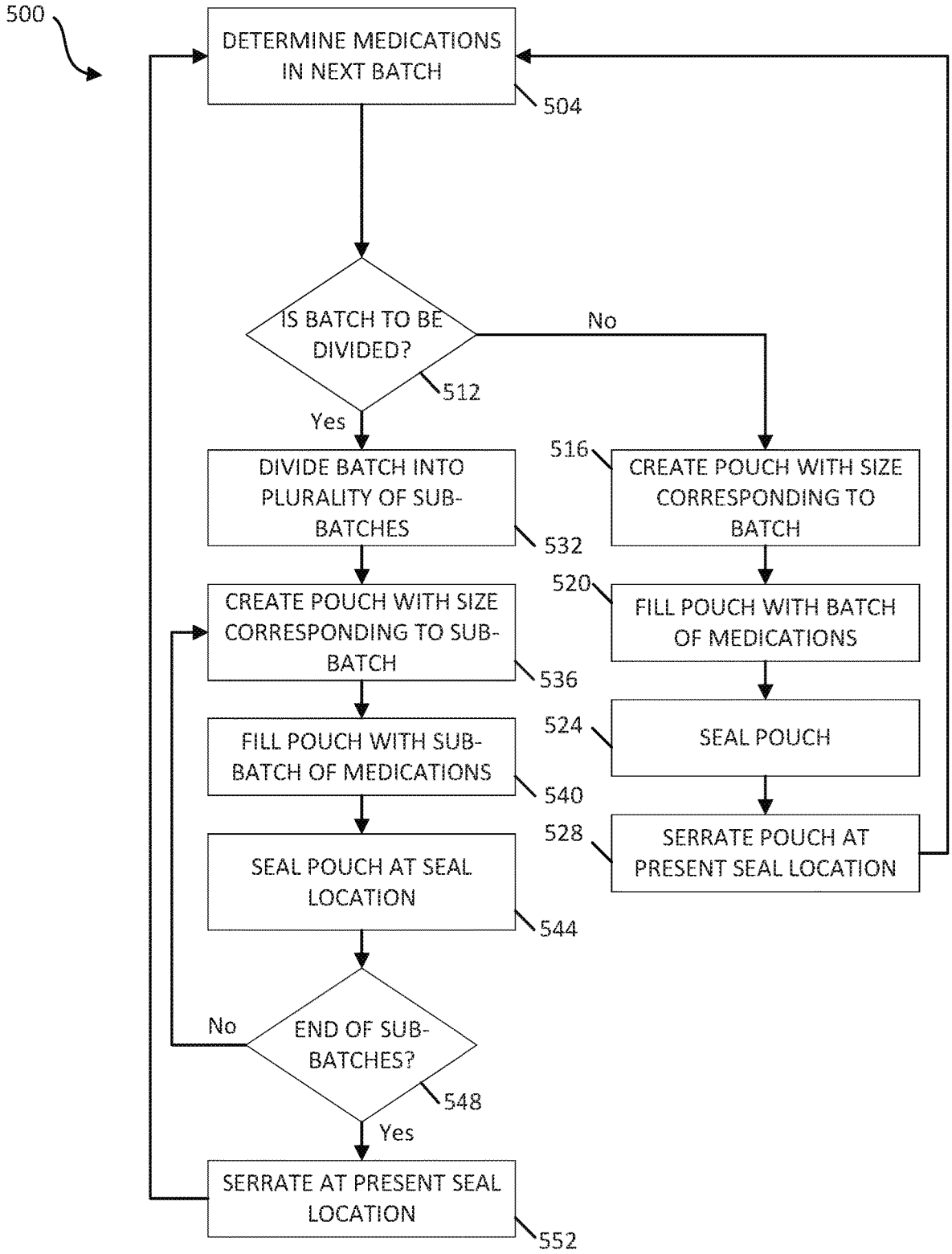
FIG. 13 is a flowchart of a method for packaging pharmaceuticals using the automatic packager of FIG. 1 in accordance with some embodiments.

FIG. 13 is a flowchart of one example method 500 for packaging medications using the automatic packager 100 in accordance with some embodiments. Although the illustrated method 500 includes a number of exemplary steps, not all of the steps need to be performed in every scenario. In some embodiments, a method of packaging medications using the automatic packager 100 may only include a subset of the steps identified in the flowchart. In addition, some methods may include additional steps.

In the method 500, the packaging unit 110 or the universal feed cartridge 105 performing a certain function or performing a block may include the electronic processor 410 controlling the packaging unit 110 or the universal feed cartridge 105 to perform the function or the block.

In the example illustrated, the method 500 includes determining, using the electronic processor 410, the medications in a next batch of medications (at block 504). The electronic processor 410 receives a prescription and determines a plurality of batches of medications based on the prescription. For example, the prescription may prescribe medications for thirty days with a first set of medications for morning, a second set of medications for afternoon, and a third set of medications for evening. The electronic processor 410 may divide the above sets into batches. For example, the first set for day one is a first batch, the second set for day one is a second batch, the third set for day one is a third batch, the first set for day two is a fourth batch, and the like. Accordingly, the electronic processor 410 may divide the above example prescription into, for example, ninety batches of medications (e.g., three batches of medication a day for 30 days). The electronic processor 410 may determine the type and amount of medications in each batch at the time the batches are created or at the time the medications are being packaged by the automatic packager. The amount of medications may include for example, the number of medications in the batch. The type of medications may include determining whether a medication releases moisture, whether a medication absorbs moisture, whether a medication is a known allergen, whether the medication belongs to a class that cannot be repackaged if previously packaged with other medications, and the like.

The method 500 includes determining, using the electronic processor 410, whether the batch of medications is to be divided based on the medications in the batch of medications (at block 512). As discussed above, providing a large number of medications in a single pouch may complicate the verification process. Additionally, some type of medications may not be packaged together with other medications. In one embodiment, the electronic processor 410 determines that a batch of medications is to be divided based on a size of the batch of medications. The electronic processor 410 may determine the size for the batch of medications based on the amount of medications in the batch. For example, the electronic processor 410 may determine the types of medications in the batch and retrieve the sizes (e.g., volume) of the medications from an internal database of the automatic packager or from, for example, the national drug code database. The electronic processor 410 determines the size for the batch based on, for example, the number of mediations multiplied by their respective sizes.

A pouch size threshold may be preset into the automatic packager. The automatic packager 100 may package batches meeting the pouch size threshold (for example, below the pouch size threshold (e.g., seven pills)) into a single pouch as described in blocks 516-528 below and may package batches exceeding the pouch size threshold into multiple pouches as described in blocks 532-552 below. The electronic processor 410 compares the size for the batch of medications with the pouch size threshold to determine whether the batch is packaged in a single pouch or in multiple pouches.

Additionally, in some embodiments, the electronic processor 410 may further determine whether the batch of medications includes incompatible medications. For example, some medications absorb ambient moisture and some medications release moisture to the surroundings. Accordingly, these medications may not be packaged together to avoid interaction. When the electronic processor 410 determines that the batch of medication includes incompatible medications, the electronic processor may divide the batch of medications into sub-batches such that incompatible medications are sealed in separate chambers.

When the batch of medications can be packaged without dividing, the method 500 includes creating, using the packaging unit 110, 300, a pouch (for example, a first pouch) with a size corresponding to the batch of medications (at block 516). As discussed above, each feed stock roll of the packaging equipment releases material 324 to form a pouch. The material 324 from each feed stock roll forms half of the pouch. The two halves are secured together along three sides or edges (e.g., the bottom and the two sides) to close the sides and form the pouch. The pouch may be formed along, for example, the plunger 150, 316.

In some embodiments, as discussed above, the printer 352 may print information of the customer, information regarding the batch of medications, and other indicia on the material 324. For example, the printer 352 may print names, doses, and other information concerning the medications within the pouch on the material 324. The printer 352 may also print an indicia (for example, a black mark) where the intended end of the pouch is expected to be. The packaging unit uses this indicia in creating a pouch with the size corresponding to the batch of medications. The size corresponding to the batch of medications may be slightly larger than the size for the batch of medications to comfortably accommodate the medications within the pouch. In some embodiments, the information and indicia on the material 324 are printed before the creation of the pouch, for example, while a previous pouch is being filled by the packaging unit 110, 300.

The method 500 also includes filling, using the packaging unit 110, 300, the pouch with the batch of medications (at block 520). The batch of medications are dispensed from the universal feed cartridge 105. As discussed above, once the pouch is formed, the plunger 150, 316 may move out of the pouch to direct the batch of medications into the pouch.

The method 500 further includes sealing, using the packaging unit 110, 300, the pouch (at block 524) and serrating, using the packaging unit 110, 300, the pouch at the present seal location (at block 528). The pouches may be serrated using, for example, a cutting mechanism in the packaging unit 110, 300. When the pouch is filled, the plunger 150, 316 moves back to the lowered position (FIG. 8) to help push the pharmaceuticals into the pouch. The material 324 is advanced, for example, to form the next pouch for the next batch or sub-batch of medications. The material 324 may be advanced until the indicia on the material 324 is detected. The plunger 316 pushes the pharmaceuticals to move the pharmaceuticals past and out of the way of the sealing mechanism 330 so the sealing mechanism 330 can make the top seal in the pouch. In some embodiments, the plunger 316 may also actuate a cam-type mechanism that moves the flapper 320 slightly ahead of movement of the plunger 316. The cutting mechanism can then create, at generally the same time and stroke, a line of serrations through the top seal between pouches to facilitate later separating the pouches. The method 500 returns to block 504 to determine the amount of medications in the next batch of medications.

Figure 14B:
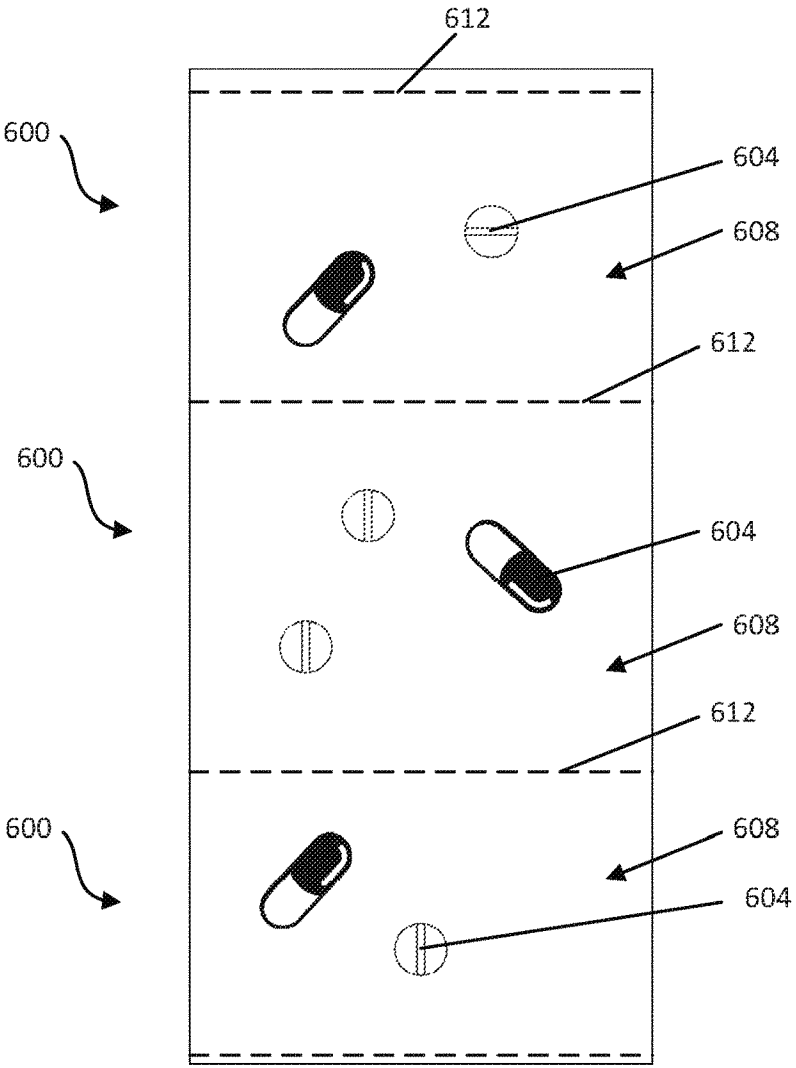
FIGS. 14A-B illustrate front and rear views of batches of medications packaged using the automatic packager of FIG. 1 in accordance with some embodiments.
Figure 14A:
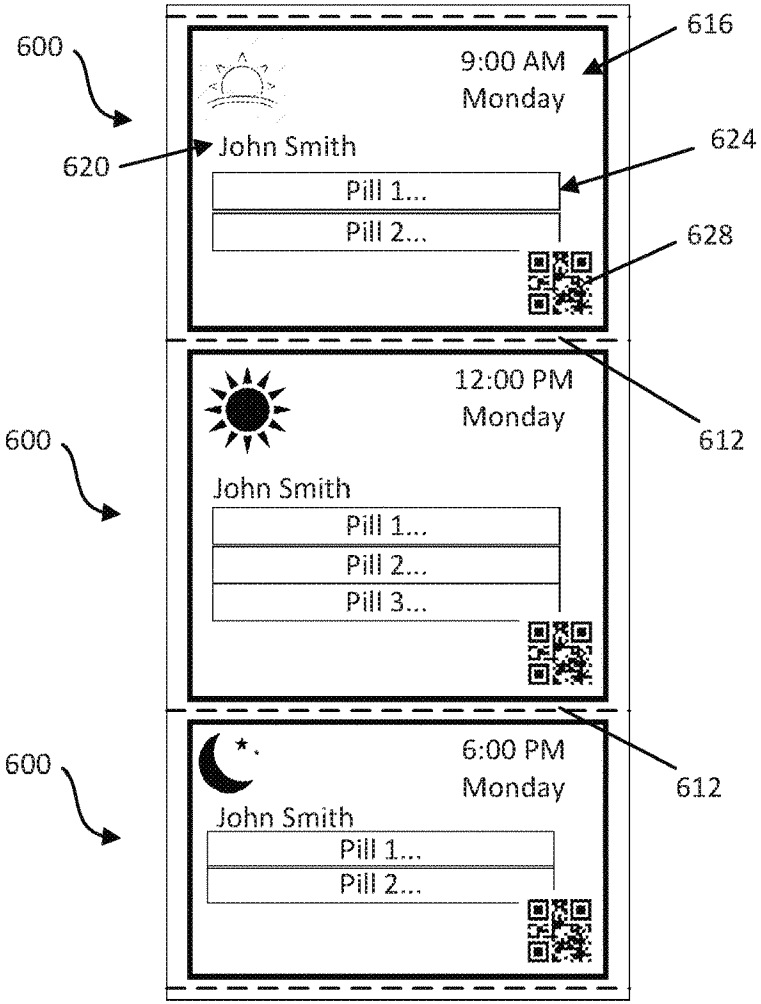

FIGS. 14A-B illustrate front and rear views of a plurality of pouches 600, each of which includes a single batch of medications 604 located in a single chamber or compartment 608. Each pouch 600 is sealed on all four sides to define the corresponding compartment 608. The adjacent pouches 600 are separated by serrations 612 or other suitable means to help separate the pouches 600 from each other. On one side of each pouch 600 (see FIG. 14A), the pouch 600 includes information related to the pouch 600 and the medications 604 contained therein. For example, the illustrated pouch 600 includes date and time information 616 on when the medications 604 should be taken, a patient's name 620, information regarding medications 624 within the pouch 600, and a scannable feature 628 (e.g., QR code, barcode, etc.) associated with the pouch 600. Other relevant information (e.g., instructions for taking the medications 604, pharmacy information, etc.) may also be printed on the pouches 600.

Such pouches 600 work well when each pouch 600 contains a relatively small number of medications (e.g., seven or less pills). If, however, more than the threshold number of medications need to be taken at a given time, multiple pouches need to be created to contain all of the medications. In some scenarios, the pouches 600 may be labeled, for example, "1 of 3", "2 of 3", "3 or 3", and the like. Such pouches may create confusion for a patient, and/or the patient may forget to take the medications in all of the pouches.

Referring back to FIG. 13, when the size exceeds the pouch size threshold, the method 500 includes dividing, using the electronic processor 410, the batch into plurality of sub-batches (at block 532). The electronic processor 410 may divide the batch into sub-batches having equal or near equal sizes or amount of medications. Alternatively, the batch may be divided into sub-batches having different sizes or amounts of medications. As discussed above, some batches of medications may include incompatible medications, which are divided into separate sub-batches.

In some embodiments, as discussed above, the printer 352 may print information of the customer, information regarding the batch or sub-batch of medications, and other indicia on the material 324. For example, the printer 352 may print names, doses, and other information concerning the medications within the pouch on the material 324. The printer 352 may also print an indicia (for example, a black mark) where the intended end of the pouch is expected to be. The packaging unit uses this indicia in creating a pouch with the size corresponding to the batch of medications. In some embodiments, the information and indicia on the material 324 are printed before the creation of the pouch, for example, while one of a previous pouch is being filled by the packaging unit 110, 300.

The method 500 also includes creating, using the packaging unit 110, 300, a pouch with the size for a sub-batch (at block 536); filling, using the packaging unit 110, 300, the pouch with the sub-batch of medication (at block 540); and sealing, using the packaging unit 110, 300, the pouch (at block 544). The pouches are created and sealed as described above in blocks 520 and 524. In some embodiments, compartments containing sub-batches of a single batch of medications are not separated by serrations. By not serrating the pouch between each compartment, the compartments containing the sub-batches are not easily separable from each other and inherently indicate to the patient that there are additional medications or pouches to be taken at the prescribed time. Accordingly, by not serrating the sub-batches within a batch, adhesion to the prescription is improved. In systems where serrations are provided between pouches of sub-batches, the user may mistakenly tear out only a portion of the medications and miss out on taking all the required medications as prescribed. The difficultly created in tearing the pouches by not serrating sub-batch pouches indicates to the user that all the pouches between the serrations are for the current time. In other embodiments, compartments containing the sub-batches of a single batch of medications are separated by serrations. In these embodiments, a user may be alerted that all of the compartments belong to the same batch of medications using the label. Specifically, the label is continuous and extends over the compartments of the batch of medications. An additionally indication, for example, a line, a color, or the like may be provided to indicate the start and finish of a batch of medications.

In some embodiments, not serrating the pouches may be achieved by temporarily moving the cutting mechanism of the packaging units 110, 300 away from the pouch material. For example, a solenoid, cam mechanism, or other suitable actuator may be coupled to the cutting mechanism. The actuator may receive a signal from the control system of the packaging unit 110, 300 to not create serrations for a given pouch when the packaging unit 110, 300 is creating a series of sub-batches. Additionally or alternatively, a cutting block (e.g., rubber strip) opposite from the cutting mechanism may be moved away from the pouches so that the cutting mechanism cannot create the serrations between sub-batches.

The method 500 includes determining, using the electronic processor 410, whether an end of the sub-batches is reached (at block 548). The electronic processor 410 determines whether all the plurality of sub-batches of the batch of medication are packaged into pouches. When the end of the sub-batches is not reached, the method 500 includes repeating blocks 536-544 until all sub-batches of the batch are sealed into pouches. When the end of the sub-batches is reached, the method 500 includes serrating the pouch at the present seal location (at block 552).

Figure 15B:
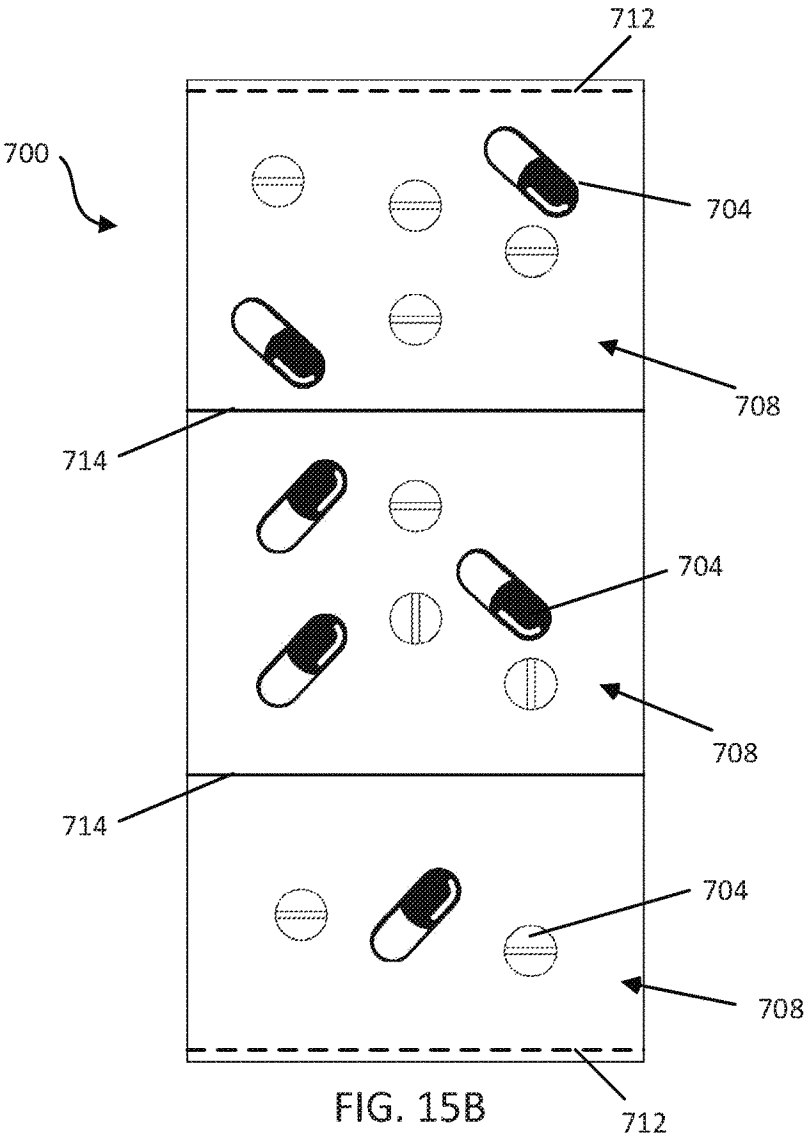
FIGS. 15A-B illustrate front and rear views of sub-batches of medications packaged using the automatic packager of FIG. 1 in accordance with some embodiments.
Figure 15A:
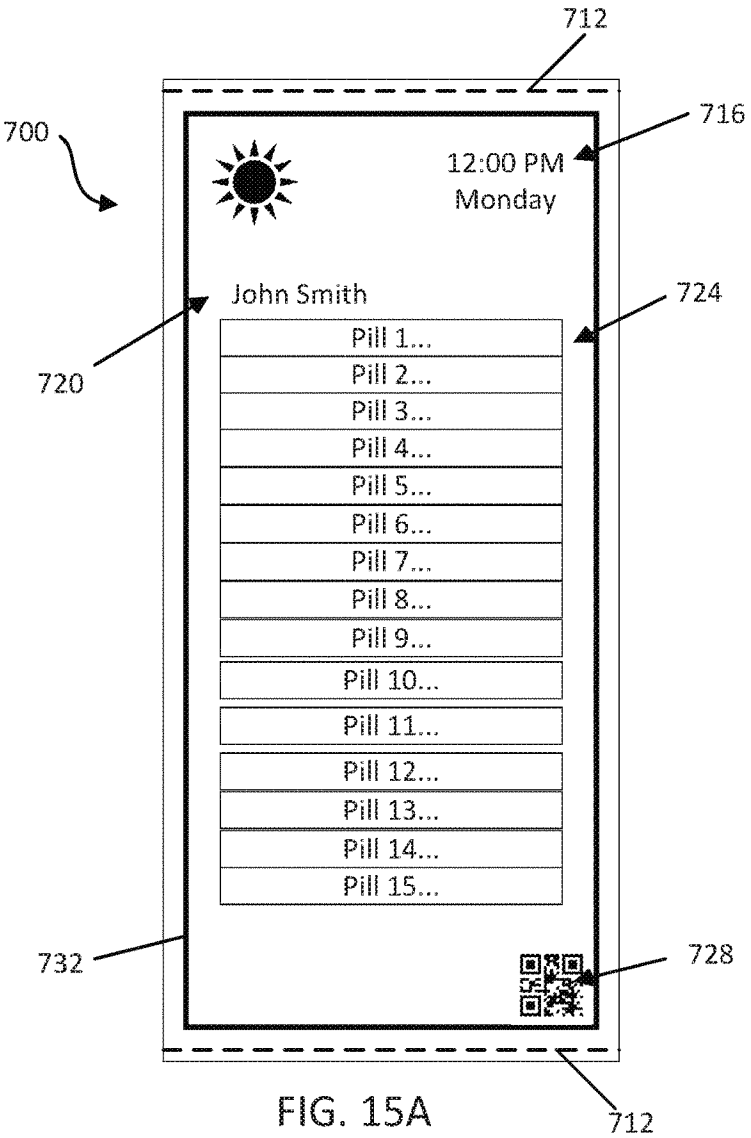

FIGS. 15A-B illustrate front and rear views of a pouch 700 including a plurality of sub-batches of medications 704 contained within separate compartments 708. The pouch 700 is defined between serrations 712 at opposite ends of the pouch 700. The pouch 700 is also designed to contain multiple sub-batches of medications 704 without serrations between adjacent compartments 708. In other words, the pouch 700 and each compartment 708 are sealed on all four sides, but the serrations 712 are only provided at the beginning and end of the overall pouch 700 (i.e., batch). As such, the individual compartments 708 of a single batch of medications cannot be easily separated. In the illustrated embodiment, the pouch 700 includes three compartments 708 separated by heat seals 714 (but not serrations). In other embodiments, the pouch 700 may be separated by heat seals 714 and serrations. It should be apparent, however, that in other embodiments the pouch 700 may include any number of compartments needed to fulfill of batch of medications.

Similar to the pouch 600 of FIG. 14A, one side of the illustrated pouch 700 (FIG. 15A) includes information related to the pouch 700 and the medications 704 contained therein. For example, the pouch 700 includes date and time information 716 on when the medications 704 should be taken, a patient's name 720, information regarding medications 724 within the pouch 700, and a scannable feature 728 (e.g., QR code, barcode, etc.) associated with the pouch 700. In some embodiments, information regarding the medications 724 may be printed to coincide with the compartment including the particular medications. For example, if medication A is provided in the first compartment and medication B is provided in the second compartment, then information regarding medication A 724 is printed on the portion of the label directly over the first compartment and information regarding medication B 724 is printed on the portion of the label directly over the second compartment. In other embodiments, the information regarding the medications 724 may not exactly align with each compartment due to the date and time information 716, patient's name 720, and size of the compartments. In such embodiments, the information regarding the medications 724 may still be presented in the order of the compartments. For example, medication(s) 704 in the first compartment may be listed first, followed by medication(s) 704 in the second compartment, etc. Other relevant information (e.g., instructions for taking the medications 704, pharmacy information, etc.) may also be printed on the pouch 700. Unlike the prior pouches, however, the date and time information 716, the patient's name 720, and the scannable feature 728 are not reprinted for each compartment 708 or sub-batch of medications. Rather, this information is only printed once, giving the sub-batches the appearance of a single continuous pouch.

In addition, the illustrated pouch 700 includes a continuous identifier that spans the plurality of compartments 708 of the batch. In the illustrated embodiment, the identifier includes a border 732. In other embodiments, the identifier may also or alternatively include an image, graphic, watermark, a line, a color, and the like that spans the plurality of compartments 708 of the batch. The identifier further enhances the appearance of one continuous pouch, yet the pouch still contains multiple discrete compartments 708 for containing a larger number of medications and/or incompatible medications.

In some embodiments, as discussed above with respect to FIG. 12, the packaging unit 110 includes a sensor 338 to detect a medication obstructing a sealing area 334 (FIG. 8)

of the pouch. The electronic processor 410 is configured to detect, using the sensor 338, a medication in the sealing area 334 of the pouch. The sensor 338 is, for example, a camera, an infra-red sensor, an optical sensor, and/or the like. In response to detecting the medication in the sealing area, the electronic processor 410 is configured to stop sealing of the pouch. By stopping sealing of the pouch, crushing of the medication and incorrect packaging of the pouch is prevented. In some embodiments, the electronic processor 410 generates an alert in response to detecting the medication in the sealing area. The alert may be in the form of an audio or alarm generated at the packaging unit 110, an audio or visual alarm generated at a device or interface used for verification of the pouch, or the like. In some embodiments, the electronic processor 410 is also configured to detect, using a sensor provided along the tracks 138, a medication in the pathway to the pouch. The electronic processor 410 may prevent sealing of the pouch and generate an alarm as described above in response to detecting a medication in the pathway to the pouch.

The electronic processor 410 may restart packaging in response to detecting that the medication is cleared from the sealing area 334 and/or the tracks 138. For example, the electronic processor 410 may receive a signal from the sensor 338 indicating that there is no medication in the sealing area 334. The medication may be cleared, for example, by a user tapping the packaging unit 110, by physical moving the medication after opening a cabinet door of the packaging unit 110, and/or the like. In some embodiments, a vibration mechanism may be provided with the sealing mechanism to clear the sealing area 334. The vibration mechanism may be operated by a vibration motor provided in the sealing mechanism 330. In response to detecting the medication in the sealing area 334 and/or the tracks 138, the electronic processor 410 activates the vibration mechanism to vibrate the pouch and to move the medication from the sealing area 334.

Various features and advantages of the invention are set forth in the following claims.

The invention claimed is:

1. An automatic packager for packaging medications, the automatic packager comprising:

a cartridge for dispensing the medications;

a packaging unit receiving the medications dispensed from the cartridge; and an electronic processor electrically coupled to the cartridge and the packaging unit, the electronic processor configured to determine medications in a batch of medications, the batch of medications corresponding to a single administration time, determine whether the batch of medications is to be divided based on the medications in the batch of medications, divide the batch of medications into a plurality of sub-batches of medications in response to determining that the batch of medications is to be divided, create, using the packaging unit, a pouch including a plurality of discrete compartments corresponding to the plurality of sub-batches of medications, and fill, using the packaging unit, the plurality of discrete compartments with the plurality of sub-batches of medications.

2. The automatic packager of claim 1, wherein the electronic processor is further configured to determine a size for the batch of medications based on the medications in the batch of medications;

determine whether the size for the batch of medications is greater than a pouch size threshold; and determine that the batch of medications is to be divided when the batch of medications is greater than the pouch size threshold.

3. The automatic packager of claim 1, wherein the electronic processor is further configured to determine whether the batch of medications includes incompatible medications based on the medications in the batch of medications;

determine that the batch of medications is to be divided when the batch of medications includes incompatible medications.

4. The automatic packager of claim 1, wherein the electronic processor is further configured to seal, using the packaging unit, the plurality of discrete compartments without serrating between adjacent compartments of the plurality of discrete compartments, and serrate the pouch at end of the pouch in response to determining that the plurality of sub-batches of medications is packaged.

5. The automatic packager of claim 1, wherein the electronic processor is further configured to determine medications in a second batch of medications, determine that the second batch of medications is not to be divided based on the medications in the second batch of medications, fill, using the packaging unit, a second pouch with the second batch of medications without creating compartments in the second pouch in response to determining that the second batch of medications is not to be divided, seal and serrate, using the packaging unit, the second pouch at an end of the second pouch.

6. The automatic packager of claim 1, wherein the electronic processor is further configured to print a continuous identifier on the pouch that spans a subset of the plurality of discrete compartments to provide an appearance of one continuous pouch.

7. The automatic packager of claim 1, wherein the packaging unit further comprises:

packaging equipment operable to form the pouch;

a track configured to direct the medications toward the packaging equipment;

a receptacle coupled to the track to receive the medications from the track, wherein the pouch is formed in the receptacle; and a sealing mechanism for sealing the pouch along a sealing area of the pouch after the medications are received in the pouch.

8. The automatic packager of claim 7, wherein the packaging unit further comprises a sensor configured to detect whether a medication is in the sealing area and wherein the electronic processor is further configured to detect, using the sensor, a medication in the sealing area; and stop sealing of the pouch in response to detecting the medication in the sealing area.

9. The automatic packager of claim 8, wherein the electronic processor is further configured to generate an alert in response to detecting the medication in the sealing area.

10. The automatic packager of claim 8, wherein the electronic processor is configured to activate a vibration mechanism configured to vibrate the pouch to move the medication from the sealing area in response to detecting the medication in the sealing area.

11. A method for packaging medications using an automatic packager, the method comprising:

determining, using an electronic processor of the automatic packager, medications in a batch of medications, the batch of medications corresponding to a single administration time;

determining, using the electronic processor, whether the batch of medications is to be divided based on the medications in the batch of medications;

dividing, using the electronic processor, the batch of medications into a plurality of sub-batches of medications in response to determining that the batch of medications is to be divided;

creating, using a packaging unit of the automatic packager, a pouch including a plurality of discrete compartments corresponding to the plurality of sub-batches of medications; and filling, using the packaging unit, the plurality of discrete compartments with the plurality of sub-batches of medications.

12. The method of claim 11, further comprising:

determining, using the electronic processor, a size for the batch of medications based on the medications in the batch of medications;

determining, using the electronic processor, whether the size for the batch of medications is greater than a pouch size threshold; and determining, using the electronic processor, that the batch of medications is to be divided when the batch of medications is greater than the pouch size threshold.

13. The method of claim 11, further comprising:

determining, using the electronic processor, whether the batch of medications includes incompatible medications based on the medications in the batch of medications;

determining, using the electronic processor, that the batch of medications when the batch of medications includes incompatible medications.

14. The method of claim 11, further comprising:

sealing, using the packaging unit, the plurality of discrete compartments without serrating seal locations between adjacent compartments of the plurality of discrete compartments; and serrating, using the packaging unit, the pouch at an end of the pouch in response to determining that the plurality of sub-batches of medications is packaged.

15. The method of claim 11, wherein the electronic processor is further configured to determining, using the electronic processor, medications in a second batch of medications, determining, using the electronic processor, that the second batch of medications is not to be divided based on the medications in the second batch of medications, filling, using the packaging unit, a second pouch with the second batch of medications without creating compartments in the second pouch in response to determining that the second batch of medications is not to be divided, sealing and serrating, using the packaging unit, the second pouch at an end of the second pouch.

16. The method of claim 11, further comprising printing, using the packaging unit, a continuous identifier on the pouch that spans a subset of the plurality of discrete compartments to provide an appearance of one continuous pouch.

17. The method of claim 11, further comprising:

forming the pouch with packaging equipment;

directing the medications along a track toward the packaging equipment;

receiving the medications from the track at a receptacle, wherein the pouch is formed in the receptacle, and wherein the pouch is sealed, using a sealing mechanism, along a sealing area of the pouch after the medications are received in the pouch detecting, using a sensor, a medication in the sealing area;

stopping, using the electronic processor, sealing of the pouch in response to detecting the medication in the sealing area;

generating, using the electronic processor, an alert in response to detecting the medication in the sealing area;

activating, using the electronic processor, a vibration mechanism configured to vibrate the pouch to move the medication from the sealing area in response to detecting the medication in the sealing area.

* * * * *